US012551027B2

(12) United States Patent
Piana et al.

(10) Patent No.: US 12,551,027 B2
(45) Date of Patent: Feb. 17, 2026

(54) NONWOVEN SMART CUSHION WITH IN-PLACE FUNCTIONALIZED PRESSURE SENSING AND THERMOPLASTIC HEAT SEALED MULTI-REGION MEASUREMENT COUPLING

(71) Applicants: PIANA NONWOVENS, LLC, Cartersville, GA (US); CONSIGLIO NAZIONALE DELLE RICERCHE (CNR), Rome (IT)

(72) Inventors: Andrea Piana, Cartersville, GA (US); Michael Stephen Defranks, Cartersville, GA (US); Andy Hollis, Cartersville, GA (US); Sang-Hoon Lim, Cartersville, GA (US); Nicola Coppede, Cartersville, GA (US); Andrea Zappettini, Cartersville, GA (US); Manuele Bettelli, Cartersville, GA (US); Marco Villani, Cartersville, GA (US)

(73) Assignees: Piana Nonwovens, LLC, Cartersville, GA (US); Consiglio Nazionale Delle Richerche, Rome (IT)

( * ) Notice: Subject to any disclaimer, the term of this patent is extended or adjusted under 35 U.S.C. 154(b) by 609 days.

(21) Appl. No.: 18/002,528

(22) PCT Filed: Jun. 24, 2022

(86) PCT No.: PCT/US2022/034822

§ 371 (c)(1),
(2) Date: Dec. 20, 2022

(87) PCT Pub. No.: WO2023/249634

PCT Pub. Date: Dec. 28, 2023

(65) Prior Publication Data

US 2025/0386947 A1 Dec. 25, 2025

(51) Int. Cl.
*A47C 31/12* (2006.01)

(52) U.S. Cl.
CPC ..... *A47C 31/123* (2013.01); *A47C 31/126* (2013.01)

(58) Field of Classification Search
CPC ... A47C 31/123; A47C 31/126; A47C 27/083; A47C 27/122; A47G 9/10;
(Continued)

(56) References Cited

U.S. PATENT DOCUMENTS 10,201,935 B2 * 2/2019 Augustine ..... H05B 3/342
10,506,668 B2 * 12/2019 Augustine ..... H05B 3/34
(Continued)

FOREIGN PATENT DOCUMENTS

CN 118434389 A * 8/2024 ..... H05B 3/342
KR 102710894 B1 * 9/2024 ..... A47C 31/123
(Continued)

*Primary Examiner* — David E Sosnowski
(74) *Attorney, Agent, or Firm* — WCF IP

(57) ABSTRACT

Examples include a functionalized compressible nonwoven material (CNM) cushion with a three-dimensional (3D) pressure-varying electrical conductance (PVEC) region. Integrated with the PVEC surface area is a conductive ink printed on thermoplastic film (CPT) single-sided conductance measurement coupling. The CPT single-sided conductance measurement coupling includes, on the thermoplastic film, N pairs of contact pads and N pairs of pad connection traces. The N pairs of contact pads are maintained, by thermoplastic adhesion, in direct electrical contact with the PVEC surface areas. The N pairs of connection traces extend from the N pairs of contact pads to trace terminals. A conductance measuring circuit selectively applies, via the N pairs of connection traces, voltage and a path to ground to the pairs of contact pads, and measures the resulting current.

23 Claims, 14 Drawing Sheets

(58) Field of Classification Search
CPC ..... A47G 2009/1018; A47G 2200/066; A47G 2200/22; A47G 2200/223; A47G 2200/226; A61G 5/1043; A61G 2005/1045; A61G 2005/1048; A61G 2005/1091; A61G 7/05; A61G 2007/0527; A61G 13/12; A61G 13/1205; A61G 13/121; A61G 13/1215; A61G 13/122; A61G 13/1225; A61G 13/123; A61G 13/1235; A61G 13/124; A61G 13/1245; A61G 13/125; A61G 13/1255; A61G 13/126; A61G 13/1265; A61G 2203/30; A61G 2203/32; A61G 2203/34; A61G 2203/44
See application file for complete search history.

(56) References Cited

U.S. PATENT DOCUMENTS

| | | | | |
|---|---|---|---|---|
| 11,534,334 | B1 * | 12/2022 | Augustine | H05B 3/342 |
| 2007/0084293 | A1 | 4/2007 | Kaiserman | |
| 2008/0275327 | A1 | 11/2008 | Faarbaek | |
| 2010/0234672 | A1 | 9/2010 | Joyce | |
| 2012/0234105 | A1 | 9/2012 | Taylor | |
| 2015/0168236 | A1 | 6/2015 | Bao et al. | |
| 2015/0366367 | A1 * | 12/2015 | Augustine | H05B 3/146 219/217 |
| 2020/0113357 | A1 * | 4/2020 | Uland | B32B 27/32 |
| 2022/0047102 | A1 * | 2/2022 | Uland | A47G 9/0215 |

FOREIGN PATENT DOCUMENTS

| | | | | |
|---|---|---|---|---|
| KR | 102850112 | B1 * | 8/2025 | H01R 4/66 |
| KR | 20250125720 | A * | 8/2025 | H04R 7/16 |
| WO | WO-2010101633 | A2 * | 9/2010 | H10D 48/50 |
| WO | WO-2012125916 | A2 * | 9/2012 | A61F 7/0097 |
| WO | WO-2014070803 | A1 * | 5/2014 | A61F 7/034 |
| WO | WO-2014094776 | A1 * | 6/2014 | H10N 30/87 |
| WO | WO-2016077742 | A1 * | 5/2016 | A47C 21/048 |
| WO | WO-2022221666 | A1 * | 10/2022 | B60N 2/0025 |
| WO | WO-2023147310 | A1 * | 8/2023 | H05B 3/36 |

* cited by examiner

NONWOVEN SMART CUSHION WITH IN-PLACE FUNCTIONALIZED PRESSURE SENSING AND THERMOPLASTIC HEAT SEALED MULTI-REGION MEASUREMENT COUPLING

TECHNICAL FIELD

This invention generally relates to cushioning device sensors and, more particularly, to integrated electrical connections and current distribution for functionalized sensor regions of nonwoven cushioning devices.

BACKGROUND

Pressure sensors can be incorporated, e.g., stitched into or otherwise inserted in mattresses and other cushioning devices. Sensor pads can be constructed, e.g., by attaching piezoelectric or other pressure sensors to a backing, and inserting such assembly in a cloth and/or plastic enclosure for use on a mattress. The piezoelectric pressure sensors can be connected via various wiring arrangements to a local interface, for connection to an external measurement device can connect.

Such techniques, though, can have shortcomings. For example, inserted piezoelectric sensors may be detectable to users, e.g., may have a different "feel," due to less flexibility or compressibility than the primary cushioning material of the mattress, topper, or pad. Wires to such sensors may be detectable to users for similar reasons. In addition, there may be difficulties in implementing durable, acceptable cost, low complexity routing, and securing of wiring to the inserted sensors, Moreover, the insertion of pressure pads and sensors into highly soft materials could interfere with the measurement process, because the soft substrate sag and absorb great part of the applied pressure, alternating the results of the measurements.

SUMMARY

According to one or more embodiments, a compressible non-woven material (CNM) cushion, e.g., a mattress, mattress topper, seat cushion, seat (home, office, airplane, automobile, etc.), can be functionalized using a conductive polymer. A functionalization process can include dipping in or injecting into a desired sensing area of the CNM cushion, a water-based solution containing the conductive polymer. After such dipping or injecting process, a drying may be performed to obtain a distribution of solidified conductive polymer on CNM fibers. The distribution obtains a pressure variable electrical conductance (PVEC), due to increasing pressure causing an increasing number of conductive polymer-coated fibers to have mutual contact. PVEC functionalization of the CNM of the cushion mattress may be provided uniformly over the entire CNM cushion, or only at specific points or regions, e.g., a row-column array or other distribution of three-dimensional (3D) regions where sensing is desired.

After such processing obtains a functionalized CNM with PVEC regions, a thermoplastic integrated, printed conductive coupling arrangement can be formed, for electrical contacts to and associated reading conductivity of, and hence pressure applied to the PVEC regions needs to be prepared to read the local conductivity of the material. The invention reported here uses a thermoplastic film, e.g., a polyurethane film, with printed conductive ink-based contacts. The film is a thermal heated to the mattress surface.

This system maintains flexibility and usability to the mattress. The contacts are prepared by printing with conductive ink (e.g., based on Ag powder ink, or on graphene-graphite powder ink, or other conductive inks), preferably with an ink jet printing machine, on the surface of a thin film of thermoplastic polyurethane. The printed contacts will follow a specific design. In general, an active area will be left uncovered, while the connection path of the contact will be covered with an isolating polymer. In this way only a specific area of the electric contact could be placed in contact to the functionalized mattress surface. After the printed film of thermoplastic polyurethane is in contact with the mattress surface, a thermal press, with, for example, a pression of 1 atmosphere (atm) and temperature of 140° C., promotes the heat adhesion process of the thin film to the CNM cushion surface. The thermal heating process guarantees complete adhesion of the film on the CNM cushion surface which results in a joining together that cannot be separated without causing damage to the thermoplastic polyurethane contact and/or the CNM cushion surface. The conductive area printed on the film results in being electrically connected to the conductive material of the mattress. The adhesion process guarantees a high stability in time under the compressions normally used on mattress and seat cushions.

In one or more embodiments, not printed areas of the thermoplastic polyurethane film may be cut away, e.g., by laser cutting, for increased transpiration of the cushion surface.

According to various embodiments, the conductive printed ink PVEC coupler can be configured as a one side PVEC region contact and current of the CNM cushion (e.g., mattress, mattress topper, seat cushion, or seat, etc.) at each point of the CNM cushion in which a sensing area should or is desired to be monitored, two contacts near one to the other (1-2 cm) are printed. Then, with a specific printed path on the surface of the thermoplastic film, the two contacts are collected in a side area of the CNM cushion, where a plastic connector with standard metal pins could be connected to the conductive paths. This process is repeated for each point of the surface where the pressure should or is desired to be monitored. In this way a matrix of 2×N contacts will measure N sensors in the CNM cushion. With this solution one side of the CNM cushion is completely free from the plastic film, while on the other side of the CNM cushion 2×N printed contacts on a film are definitively connected by thermal heating to the CNM cushion surface. In this way, when the active conductive material of the CNM cushion is pressed over two near contacts on the same side, the vacuum in the CNM cushion collapses and the conductivity between the two points increases proportionally to the pressure applied. Hence, each of the N sensors will read the pressure of the area over the two contracts that are placed on one side by thermoplastic film. With this solution only one side of the CNM cushion connects with the thermoplastic film, making the surface of the CNM cushion in contact with the user more breathable and transpiring. This increases the comfort of the user. In a particular example of a mattress or mattress topper, the thermoplastic film and contacts can be positioned on the mattress or mattress topper surface opposite that which the user lays on, thereby improving the overall resting comfort of the user.

In the second configuration the contacts are printed on both sides of the CNM cushion (e, g, mattress, mattress topper, seat cushion, or seat, etc.) in a scheme that can be described as "rows and columns." In this configuration the contacts are conductive straight lines separated by nonconductive areas on the thermoplastic polyurethane film. On one side of the CNM cushion the contacts are heat scaled with the conductive lines in one direction, and on the other side the conductive lines are rotated by 90 degrees respect to the lines in the first side. In such a way, the configuration results in rows on top and columns (rotated by 90 degrees) on bottom (or vice versa). In this configuration, by reading the resistance between one row and one column, the conductivity of a selected area or the entire CNM cushion is measured between the two lines. This configuration reduces the breathability and transpiring properties of the mattress only slightly, but also reduces the number of connections.

Using these configurations, with an opportune functionalization of the CNM cushion active material and with the heat-scaled contacts, using a thermoplastic polyurethane film, the CNM cushion can be measured in all the sensor matrix, by scanning continuously the electrodes. A fixed low voltage (1-5 V) can be applied in sequence to all the electrodes and the relative currents could be measured. The scanning frequency could be very fast, giving a continuous series of data that shows the pressure of the user body on, for example, a mattress, a mattress topper, a seat, a seat cushion, etc. The spatial resolution of the sensor matrix depends on the configuration and on the number of contacts. With specific electronics designed for each configuration, the CNM cushion could give precise local information of the posture of the user, on his or her movement, and on the quality of his or her sleep (in the case of a mattress or mattress topper).

Features and benefits of securing by thermoplastic film in accordance with disclosed embodiments include, but are not limited to, end product benefits, e.g., positive securing of the contact pads in direct electrical contact with the PVEC surface, low mass securing, avoidance of conventional adhesive materials and their respective shortcomings, such as brittleness with age, cracking due to repeated flexing, repeated temperature cycling, can have direct costs, e.g., chemicals, physical flexibility, and durability and processing benefits, e.g., low cost, high yield—low defect rate fabrication, low mass securing, no adhesive materials, e.g., chemicals, physical flexibility, and durability.

According to one or more embodiments, an example apparatus can include a functionalized pressure-varying electrical conductance (PVEC) cushion with integrated PVEC coupling, and can include a compressible nonwoven material (CNM) cushion, having a cushion surface and a three-dimensional (3D) functionalized PVEC region that comprises CNM fibers supporting a distributed coating of conductive polymer and having a PVEC surface area on the cushion surface. The example apparatus can further include a PVEC measuring coupler, which can be secured by an adhesion to the cushion surface, and comprising a thermoplastic film and, on disposition areas of cushion-facing surfaces of the thermoplastic film, conductive ink elements, including a pair of contact pads, mutually spaced by a pad spacing, and a pair of pad connection traces. In the example apparatus, one of the pad connection traces an extend from one of the contact pads to a trace terminal among a pair of trace terminals, and the other of the pad connection traces extending from the other of the contact pads to the other of the trace terminals. In the example apparatus, the adhesion can comprise heat sealing adhesion to the cushion surface of areas of the cushion-facing surfaces of the thermoplastic film outside the ink disposition areas, and the pair of contact pads can be in direct electrical contact with the PVEC surface area. Also, the PVEC measuring coupler, or the CNM cushion, or both, can further comprise insulation configured to insulate the pair of pad connection traces from the PVEC surface area.

According to one or more embodiments, an example method can provide functionalizing a CNM cushion, into a functionalized PVEC CNM cushion with a conductive ink printed-on-thermoplastic film (CPT), multi-area PVEC conductance measurement coupling. Steps of the example method can include functionalizing the CNM cushion into a PVEC CNM cushion, including a forming within the CNM cushion of a 3D CNM PVEC region, having a PVEC surface area on a surface of the CNM cushion, the 3D CNM PVEC region having a structure comprising conductive polymer carrying CNM fibers, at least partially covered with a thin film of solidified conductive polymer, and elastically separated by a pressure dependent distribution of empty spaces. The example method can also include forming the CPT multi-area PVEC conductance measurement coupling by steps comprising conductive ink printing a configuration of conductive elements on disposition surfaces of a surface of a thermoplastic film. In the example method, the configuration of conductive elements can include a first conductive contact pad and a second contact pad mutually spaced by a pad spacing, and can include a first pad connection trace that extends from a first pad connection trace terminal end to the first contact pad, and a second pad connection trace that extends from a second pad connection trace terminal end to the second conductive contact pad. Steps in the example method can further include adhering, in an alignment, the CPT multi-area PVEC conductance measurement coupling to a surface of the PVEC CNM cushion, including the PVEC surface area. In the example method, the adhering can comprise heat and pressure urging of portions of the surface of the thermoplastic film to extend over upper surfaces of the conductive elements and onto adjacent areas of the surface of the functionalized CNM PVEC cushion. Further, the alignment can include the first conductive contact pad and the second conductive contact pad each being in direct electrical contact with the PVEC surface area. Further, the insulation can be configured to electrically insulate the first pad connection trace at least from the PVEC surface area, and to electrically insulate the second pad connection trace at least from the PVEC surface area.

According to another one or more embodiments an example method can include provisioning a functionalized CNM cushion having integer N 3D PVEC regions, with CPT, multi-area PVEC measurement coupling. Steps in the example method can further include forming the CPT multi-area PVEC conductance measurement coupling, and steps in the forming can include conductive ink printing a configuration of conductive elements on disposition surfaces of a surface of a thermoplastic film, the configuration of conductive elements including integer N conductive contact pad pairs, each nth contact pad pair including a first conductive contact pad and a second contact pad mutually spaced by a pad spacing, and including integer N pad connection trace pairs. In the example method, each Nth pad connection trace can correspond to an Nth conductive pair, which can include a first pad connection trace that extends from a first pad connection trace terminal end to the first contact pad of the Nth conductive contact pad pair, and a second pad connection trace that extends from a second pad connection trace terminal end to the second conductive contact pad of the Nth conductive contact pad pair. In the example method, steps can further comprise adhering, in an alignment, the CPT multi-area PVEC conductance measurement coupling to a surface of the PVEC CNM cushion, including the PVEC surface area. The example method, in accordance with the one or more embodiments the adhering may include heat and pressure urging of portions of the surface of the thermoplastic film to extend over upper surfaces of the conductive elements and onto adjacent areas of the surface of the functionalized CNM PVEC cushion. Further, in the example method steps can include, in the alignment, the first conductive contact pad and the second conductive contact pad of each nth conductive contact pad pair each being in direct electrical contact with the associated nth PVEC surface area. In the example method, the insulation can be configured to electrically insulate the first pad connection trace and the second pad connection trace of each Nth pad connection trace pair from at least from the nth PVEC surface area.

This Summary identifies example features and aspects and is not an exclusive or exhaustive description of disclosed subject matter. Whether features or aspects are included in or omitted from this Summary is not intended as indicative of relative importance of such features or aspects. Additional features are described, explicitly and implicitly, as will be understood by persons of skill in the pertinent arts upon reading the following detailed description and viewing the drawings, which form a part thereof.

DETAILED DESCRIPTION

Figure 1A:
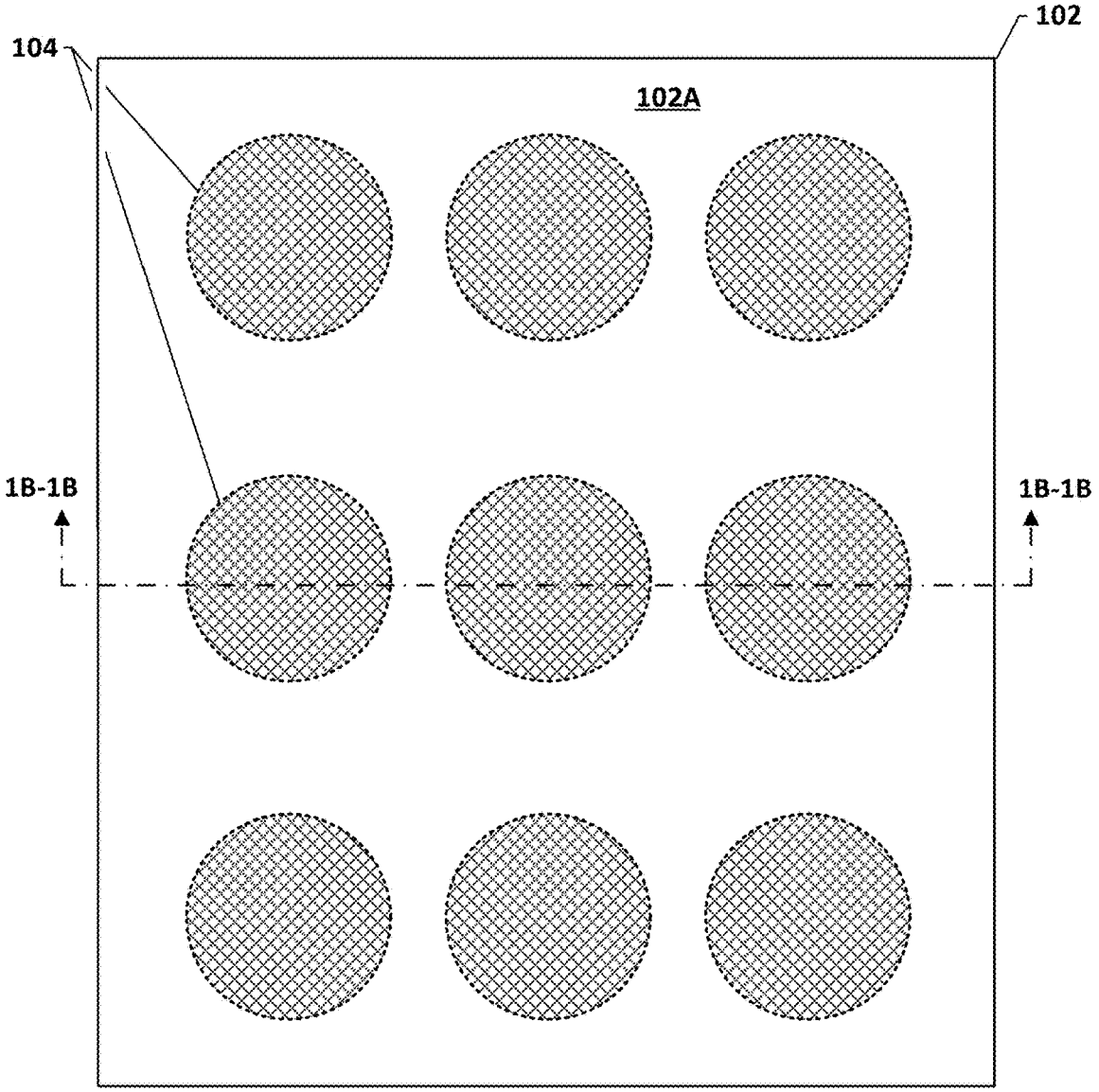
FIG. 1A shows a surface view diagram of example cushion surface visible areas of pressure varying electrical conductance (PVEC) regions of an example PVEC functionalized compressible nonwoven material (CNM) cushion having a row-column array of example 3D columnar PVEC regions, to which conductive ink printed-on-thermoplastic (CPT) PVEC conductance measurement couplers according to various embodiments can be integrated.

In an embodiment, a functionalization process can be applied to transform a CNM cushion to a functionalized CNM PVEC pressure sensing cushion with one or more 3D PVEC regions. Example functionalization processes, described in more detail in later sections of this disclosure, can establish a conductive polymer-coated fiber structure for the 3D CNM PVEC regions that exhibits both the cushioning function of the original CNM and the pressure-varying electrical conductance function.

The arrangement 400A, for purposes of description, will be alternatively referenced as a "conductive ink printed-on-thermoplastic film (CPT), multi-area PVEC conductance measurement coupling 400A," or "CPT multi-area PVEC conductance measurement coupling 400A." It will be understood that "CPT," as used herein, is a coined abbreviated recitation of "conductive ink printed-on thermoplastic film," and has no intrinsic meaning.

The term "one-sided" is used herein as a reference for couplings in accordance with various embodiments providing, using configurations of conductive contact pad pairs and pad connection trace pairs integrated on only one side or surface, e.g., on only a top surface or only a bottom surface of a functionalized CNM PVEC mattress, monitoring of conductance of a plurality of PVEC regions of the functionalized CNM PVEC cushion, or at a plurality of locations distributed about a PVEC surface of a functionalized CNM PVEC cushion.

According to various embodiments processes can also include conductive ink printing on a first side of a plastic or insulative film, such as a thermoplastic film, a configuration of conductive elements. The conductive ink printing can use, for example and without limitation, Ag powder ink, or on graphene—graphite powder ink, or various other conductive inks, and can be performed, for example, with a conventional ink jet printing machine such as is available from various commercial vendors. Ink jet printing is performed on the surface of a thin film arrangement of PVEC region conductive contact pads and pad connection races. The thermoplastic film can be composed, for example and without limitation, of thermoplastic polyurethane or other material which can be heated to a point of melting for entanglement in the nonwoven material of the surface of the CNM cushion and solidifying to join to the surface of the CNM cushion without altering overall breathability and cushioning properties of the nonwoven material. In some embodiments, processing can include an insulation layer, e.g., insulating polymer, on at least certain portions of the pad connection traces. Functionality of the insulation layer can include avoidance of undesired electrical contact between the pad connection traces and PVEC surfaces.

Processing according to various embodiments can include positioning, e.g., by robotic movements, the thermoplastic film with a conductive ink printed arrangement of PVEC region contact pads and pad connection traces such that the thermoplastic film first side, and therefore the exposed surfaces of the PVEC region contact pads, faces an appropriate surface area of the functionalized CNM cushion device. The appropriate surface area, in an embodiment, is an area having surfaces of in-place functionalized 3D PVEC regions corresponding to which the PVEC region conductive contact pads are intended to contact. As an illustration, assume an example functionalized CNM cushion having a 3×3 array of 3D PVEC regions, and that a pair of adjacent PVEC region conductive contact pads is to be placed into contact with each of such PVEC regions. In such example, the thermoplastic film's conductive ink printed PVEC region contact pads include a 3×3 array of pairs of the pads, arranged in correspondence to the CNW cushion's 3×3 array of 3D PVEC regions. In such an example, robotic positioning can align the thermoplastic film's correspondingly arranged 3×3 array of pairs of conductive contact pads to the CNW cushion's 3×3 array of 3D PVEC regions.

Processing according to various embodiments can proceed from the above-described positioning and alignment to an urging, e.g., by robotic movement, the thermoplastic film, such that conductive ink printed PVEC region contact pads align contact, physically and/or electrically, corresponding surface areas of the PVEC cushion devices. In an embodiment, heat can also be applied, such that the thermoplastic film molds around sides or shoulders of the conductive ink printed PVEC contact pads and pad connection traces, and extends onto and to adheres to adjacent surfaces of the functionalized CNM cushion device.

Structural features resulting from the above-described processing can include, but are not limited to a functionalized CNM cushion device with integrated, functionalized 3D CNM PVEC cushion regions that are electrically coupled, e.g., to a measurement interface, by a surface-integrated, well-secured, low profile, low mass, flexible, and durable electrical connections to the one or more functionalized 3D PVEC cushioning regions.

Applications can include, without limitation, a smart mattress or mattress topper, a seating surface (e.g., automobile chairs, airline chairs, boat chairs, desk chairs, etc.), or any other cushioning article where pressure monitoring is desirable. Features of a CNM smart mattress can include, without limitation, measurement and display of pressure distribution, pressure points, which can be utilized to improve, for example, posture and sleep quality. Features of a seating surface sensor in automobiles may also be related to posture and comfort sensing.

Further features of one-sided CPT multi-area PVEC measurement coupling according to various embodiments can include, without limitation, low man-hour, low material cost adaptability to different cushion shapes and types, transparency to user, reasonable production capability of monitoring pressure under substantially any arrangement of contact pad pairs.

Example 1—Functionalized CNM PVEC Pressure Monitoring Cushion with Integrated One-Sided, Conductive Ink Printed-On-Thermoplastic Film (CPT), Multi-Area PVEC Measurement Coupling According to Various Embodiments Apparatuses according to various embodiments can include a functionalized CNM PVEC cushion that comprises one or more PVEC regions and, integrated with the functionalized CNM PVEC cushion, a novel structure, light weight, low profile, flexible, durable, one-sided CPT multi-area PVEC measurement coupling. According to various embodiments an example one-sided CPT multi-area PVEC measurement coupling can include, printed on areas of an undersurface of an overlaying thermoplastic film, a plurality of contact pad pairs and corresponding pad connection trace pairs. According to various embodiments the contact pad pairs are in direct electrical contact with PVEC region surface areas, and are firmly and securely maintained in electrical contact by the thermoplastic film, and the film's extension over the contact pad pairs and the pad connection traces, and to the film's heat-pressure adhesion to proximal surfaces of the functionalized CNM PVEC cushion.

In various embodiments, contact pad pairs can include a first contact pad and second contact pad, spaced apart by a pad spacing. The first contact pad and the second contact pad can have respective unencumbered top surfaces that, as described above, can be in direct electrical contact with their associated PVEC region surface area. The contact pad connection trace pairs can include a first contact pad connection trace which can extend from the first contact pad to a first trace connection terminal, and a second contact pad connection trace which can extend from the second contact pad to a second trace connection terminal. As described in more detail in later paragraphs, in one or more embodiments, the first trace connection terminals and second trace connection terminals can be arranged in or as a connector trace connection tab, e.g., for connection to conductance measurement resource, or to circuitry configured for interfacing to a conductance measurement resource.

According to various embodiments, an insulation can be provided, for example and without limitation, via deposition of an insulating material, such as an insulating polymer, e.g., on surfaces of pad connection traces that, absent the insulation, may have electrical contact with the PVEC surface area adjacent the connection trace's corresponding contact pad.

An example CPT multi-area PVEC measurement coupling will be described in reference to FIGS. 4A-4F. The example uses, for purposes of description, the FIG. 1A-1B functionalized CNM PVEC cushion is referenced. The example is not intended as a limitation on the scope of practices according to disclosed embodiments.

Figure 3:
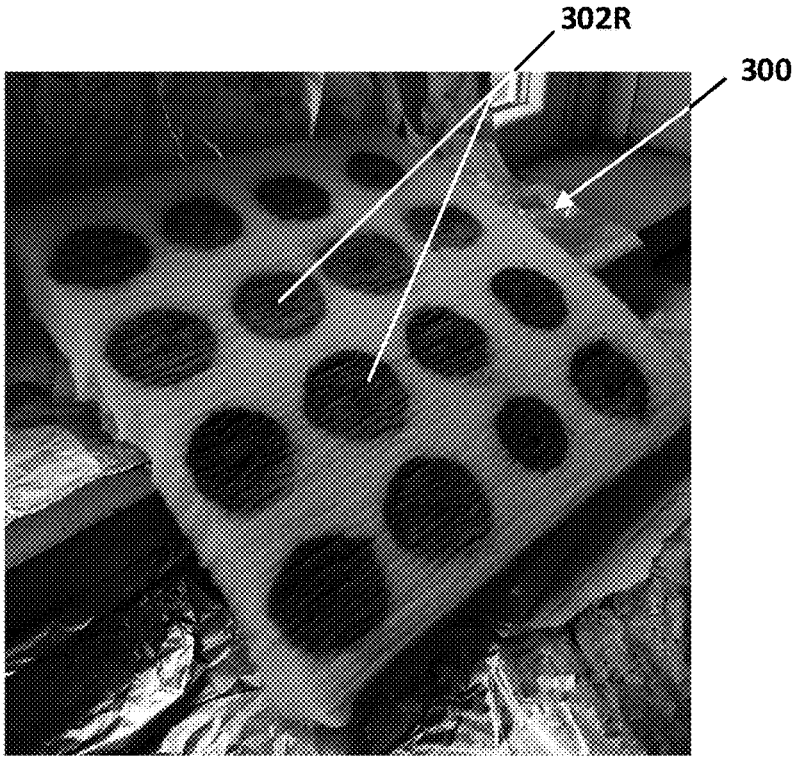
FIG. 3 shows a photo-image of a front surface of a functionalized CNM cushion with a 4×4 array of CNM PVEC regions.
Figure 4A:
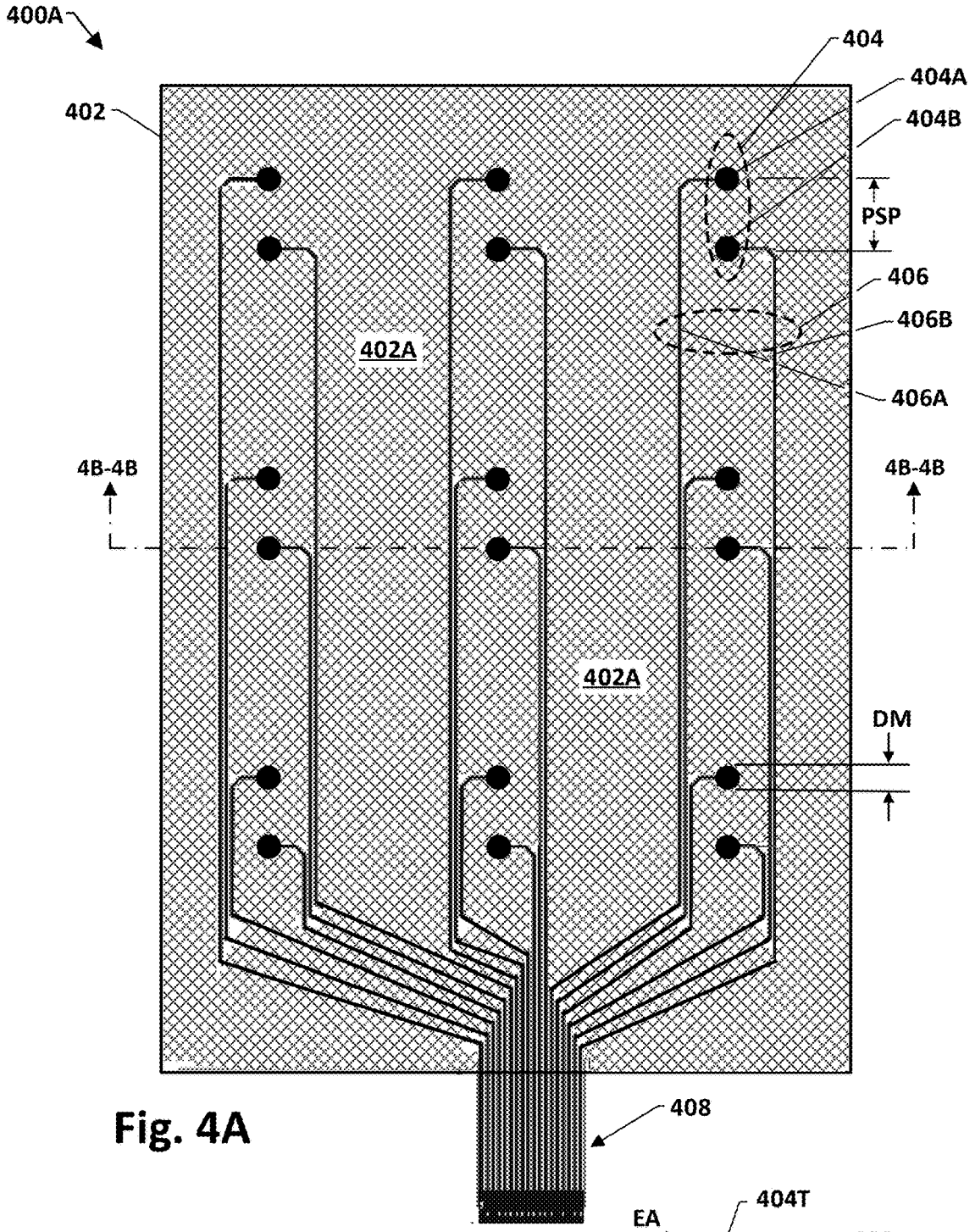
FIG. 4A-4F illustrate, via diagrammatic snapshots of operations and in-process structures, a process flow in producing and heat seal integration, on a functionalized CNM PVEC cushion with a row-column array of PVEC regions, an example one-side CPT multi-area PVEC conductance measurement coupling according to one or more one-sided embodiments.

Referring to FIG. 4A, a process can start by printing on a first surface 402A of a thermoplastic film 402 a CPT arrangement of conductive elements. The thermoplastic film 402 can be, but is not necessarily, thermoplastic polyurethane. The FIG. 4A thermoplastic film 402 with the CPT arrangement of conductive elements will be referred to as a one-sided CPT arrangement multi-area PVEC measurement coupler 400A. The CPT arrangement of conductive elements in the one-sided CPT arrangement multi-area PVEC measurement coupler 400A can include integer N pairs 404 of conductive contact pads, which will be generically referenced as "conductive contact pad pair(s) 404." The arrangement of conductive contact pad pairs 404, according to some examples, such as illustrated by FIGS. 4A-4F, can provide one conductive contact pad pair 404 for each PVEC region. This is visible in FIG. 4A, showing integer 9 contact pad pairs 404, in a 3×3 row-column arrangement matching the row-column arrangement of the FIG. 1A-1B 3d PVEC regions 104. Each conductive contact pad pair can include a first conductive contact pad 404A, and a second conductive contact pad 404B, each having a diameter DM, and mutually separated by a center-to-center pad spacing PSP. The diameter DM can vary widely (e.g., 0.5 to 6 inches, etc.) depending on the application, and the diameter DM can be the same or different for different columns in the CNM cushioning device. Moreover, the columns can be cylindrical, polygonal, or any other desired shape.

The arrangement of conductive elements can also include, for this example integer 9 and more generally integer N, pad connection trace pairs 406, each associated with a corresponding conductive contact pad pair 404. In an example, each pad connection trace pair 406 can include a first pad connection trace 406A that extends from the first contact pad 404A of the associated contact pad pair 404 to a first trace connecting end, and can include a second pad connection trace 406B that extends from the second contact pad 404B of the associated contact pad pair 404 to a second trace connecting end. The FIG. 4A example arrangement of conductive elements has 9 contact pad pairs 404 and 9 pad connection trace pairs 406, meaning 9 first pad connection traces 406A and 9 second pad connection traces 406B. For reasons including capability of ready coupling to PVEC conductance measurement resources, described in more detail in later paragraphs, the 9 first trace connecting ends and 9 second trace connecting ends can be arranged in, or as able to be connected to using FIG. 4A resource item 408. For purposes of description resource item 408 is referenced herein as a "trace connecting tab 408."

It will be understood that the reference names "first" and "second" are arbitrary with respect to which among the first and second pad connection traces 406A, 406B connects to which among the first and second contact pads 404A, 404B of the corresponding contact pad pair 404.

Figure 4B:
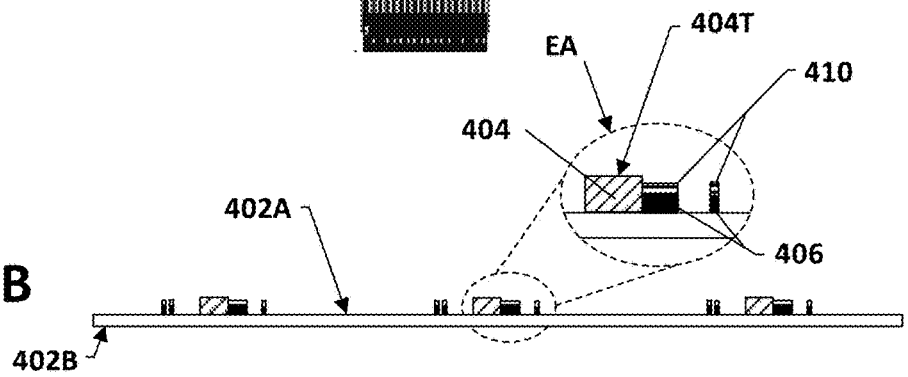

FIG. 4B shows a cross-section view of the CPT multi-area PVEC conductance measurement coupling 400A, viewed on the FIG. 4A cross-section projection plane 4B-4B. The projection plane 4B-4B shows only the second conductive contact pads 404B of the middle row of contact pad pairs 404. Referring to the FIG. 4B enlarged area "EA," it is seen that the first contact pad 404 has an exposed conductive top surface 404T. The second contact pad 404B can have an identical or similar exposed top surface, but is not visible in the projection plane 4B-4B. It will be understood that the term "top," as used herein in the context of "exposed conductive top surface 404T," is in reference to a point of maximum distance from the surface 402A of the thermoplastic film 402, which is not necessarily related to gravitation up and down.

Also shown in the enlarged area EA, an insulation 410 is shown covering or formed on at least portions of the tops of the pad connection trace pair 406 associated with the EA contact pad pair 404. The FIG. 4A-4F graphic form of the insulation 410 is a representation of the insulation 410 function, and is not intended as a descriptor or guideline as to specific structure or placement of the insulation 410. The insulation 410 function is avoidance of, or reducing to acceptable level the probability of, electrical connection between either of the connection traces 406A, 406B forming the pad connection trace pair 406 and the PVEC surface area that the contact pad pair 404 contacts. Specific structure of the insulation 410 for performing that function can depend, at least in part, on what points or surfaces, if any, of the connection traces 406A, 406B would, absent the insulation 410, electrically contact the PVEC surface area 104 associated with the trace 406A and 406B associated contact pad pair 404. Persons of skill in the pertinent arts, upon reading this disclosure in its entirety, can readily determine acceptable specification limits of such electrical contact that should be met to meet a desired and reasonable conductance measurement accuracy and, based on such determined specification limits, can readily identify one or more insulation materials, and configure one or more arrangements of such insulation materials to obtain one or more acceptable implementations of the insulation 410. A guideline for such determination of specification limits, which persons of skill in the pertinent arts will understand upon reading this disclosure in its entirety, is that features of measuring conductance of PVEC regions 104 according to various embodiments can measure, effectively, an inverse of the resistance of the CNM PVEC path through which electrical current flows when passing from one to the other of the first and second contact pads 404A, 404B. For any contact pad pair 404, electrical contact between the PVEC surface area 104 served by said contact pad pair 404 and the pad connection trace pair 406 that connects to the subject conductive contact pad pair 404 may effectuate another path characteristic.

Figure 4C:
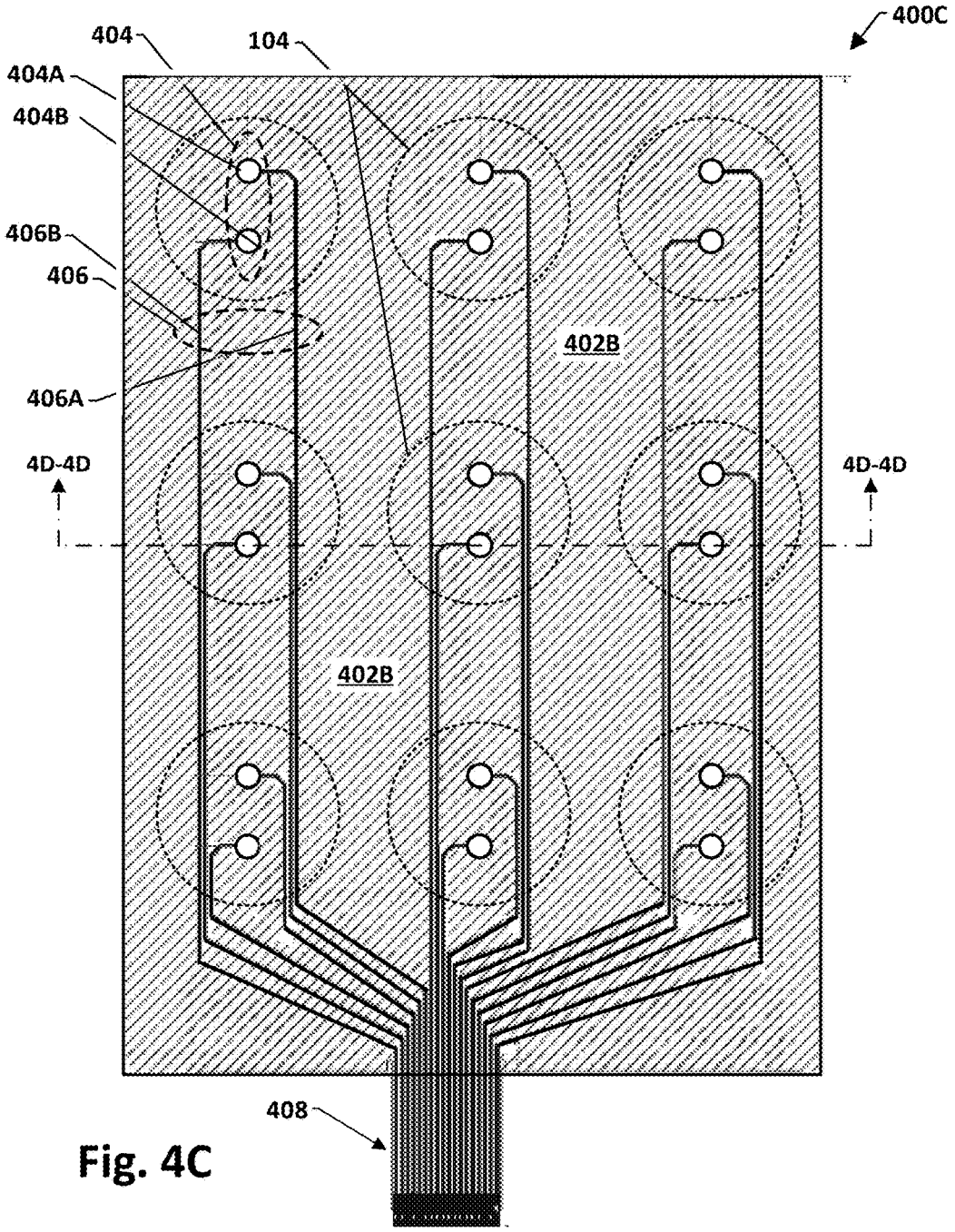
Figure 4D:
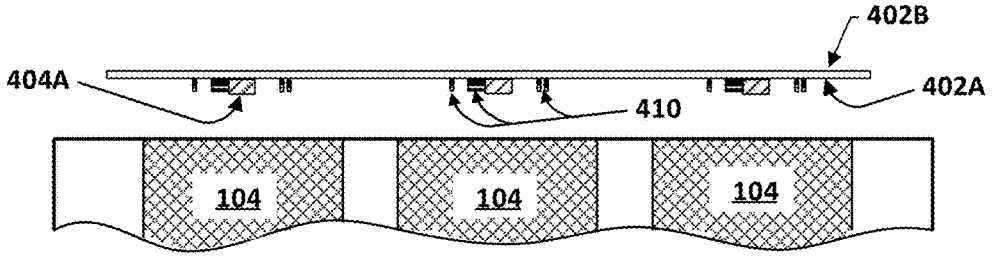

In processes according to various embodiments steps can proceed from the state illustrated by FIGS. 4A and 4B, to a spatial orientation and alignment shown by top view on FIG. 4C, and in cross-section on FIG. 4D, as seen from the FIG. 4C cross-cut projection 4D-4D. The state 400C spatial orientation includes the surface 402B of the thermoplastic film 402, now an underside surface 402A, facing the surface 102A of the functionalized CNM PVEC cushion 102. The alignment can include the contact pad pairs 404 aligned with the PVEC surface areas 104A.

Figure 4E:
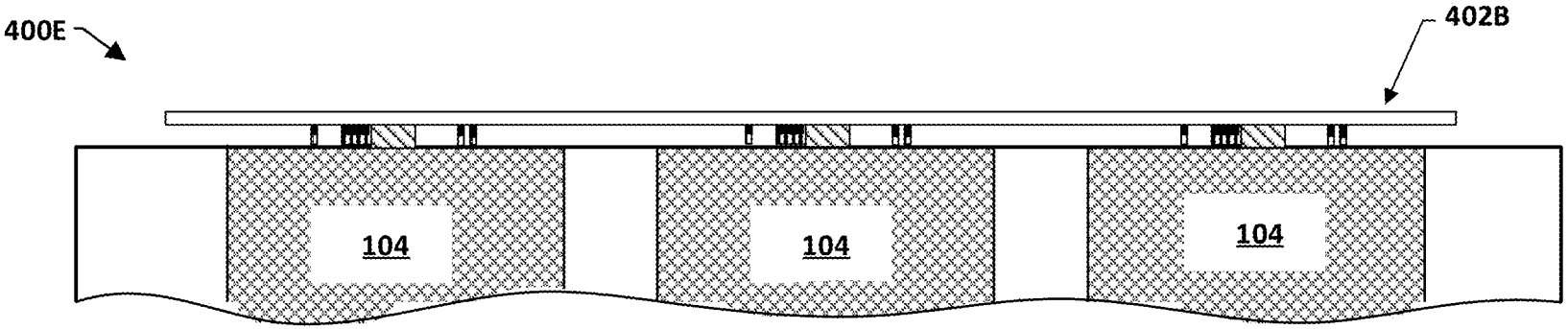

Processes according to various embodiments can proceed from the FIG. 4C to a further positioning of the CPT multi-area PVEC conductance measurement coupling 400A, in accordance with alignment, that can proceed until top surfaces 404A and 404B of the conductive contact pad pairs 404 directly contact, physically and electrically, the corresponding PVEC surface area 104A and at least portions of the underside surface 402A of the thermoplastic film 402 contact the top surface of the functionalized CNM PVEC cushion 102. FIG. 4E shows an example of the conductive contact pad pairs 404 directly contacting the corresponding PVEC surface area 104A and at least portions of the underside surface 402A of the thermoplastic film 402 contacting the top surface of the functionalized CNM PVEC cushion 102.

In one or more embodiments processing can proceed to applying pressure on the CPT multi-area PVEC conductance measurement coupling 400A, urging the surface 402A of the thermoplastic film 402 and the conductive elements against the surfaces 102A and 104A of the functionalized CNM PVEC cushion, and/or to applying a heating to the CPT multi-area PVEC conductance measurement coupling 400A, or both. In accordance with one or more embodiments, the applying of the pressure, or the heating, or both, can continue until respective portions of the thermoplastic film extend over upper surfaces of the conductive elements, e.g., over upper surfaces of the conductive contact pad pairs and over upper surfaces of the pad connection trace pairs, or the insulation on the pad connection trace pairs and onto and adhere to the adjacent areas of the surfaces and of the functionalized CNM PVEC cushion.

Figure 4F:
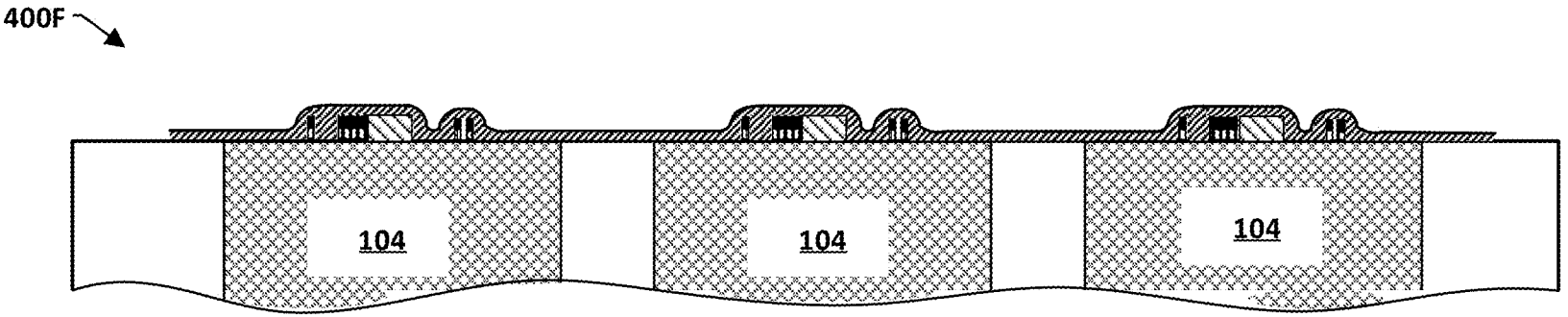

FIG. 4F shows an example of respective portions of the thermoplastic film 402 extending over upper surfaces of the conductive elements, e.g., over upper surfaces of the conductive contact pad pairs 404 and over upper surfaces of the pad connection trace pairs 406 or the insulation 410 on the pad connection trace pairs 406 and onto and adhering to adjacent areas of the surfaces 102A and 104A of the functionalized CNM PVEC cushion 102.

Figure 5:
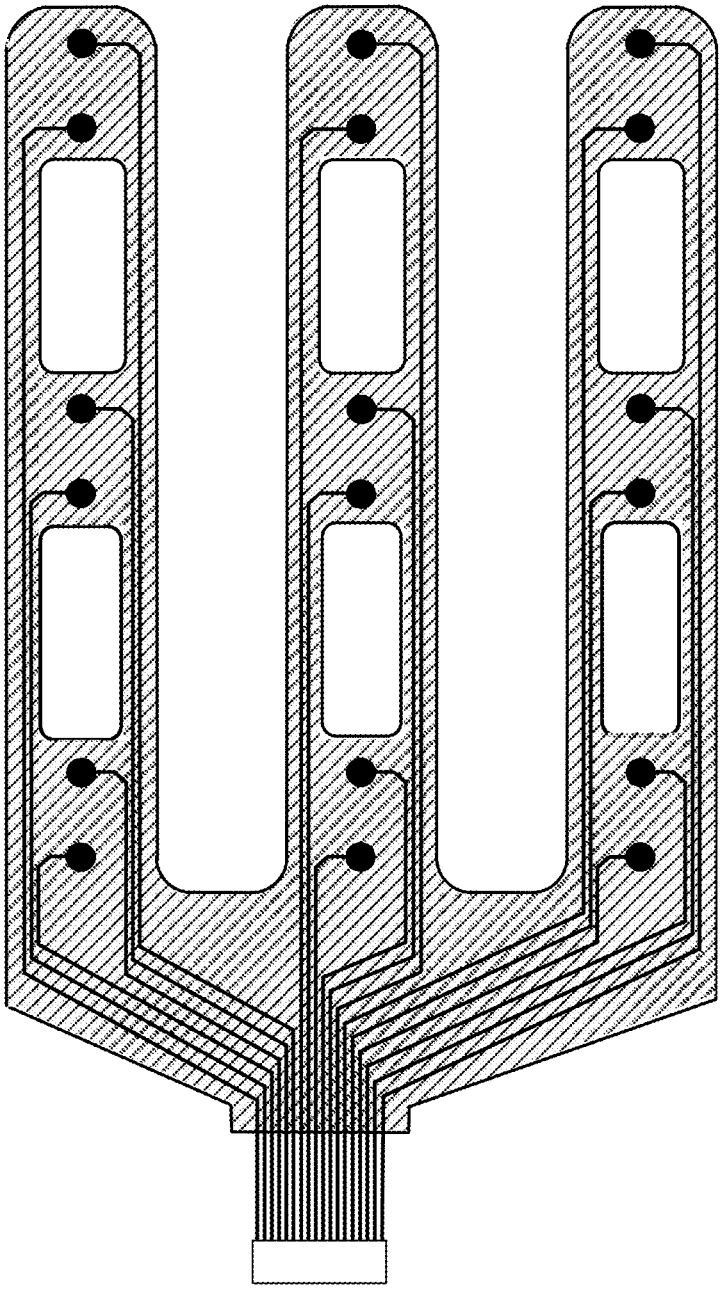
FIG. 5 shows a trimming diagram illustrating an example configuration of an optional trimming of non-printed thermoplastic film regions, in a process for forming a one-sided CPT multi-area PVEC conductance measurement coupler according to one or more embodiments.

FIG. 5 shows a top view diagram of an illustrative cutting away of not printed regions of the thermoplastic film 402 of the FIG. 4C CPT multi-area PVEC conductance measurement coupling 400C. The cutting away can be performed, for example, as a laser cutting, prior to FIG. 4E-4F heat-pressure integration of the FIG. 4C CPT multi-area PVEC conductance measurement coupling 400C to the surface of the FIG. 1A-1B functionalized CNM CVEC cushion 102. Laser cutting as illustrated on FIG. 5 can, for example, facilitate transpiration of the surface of the cushion 102.

Example 2—Pressure Monitoring System, with PVEC Conductance Measurement Resource Coupled to Functionalized CNM PVEC Cushion with Integrated One-Sided CPT Multi-Area PVEC Conductance Measurement Coupling According to various embodiments, a conductance measurement resource can connect to a single-sided CPT multi-area PVEC conductance measurement coupling such as described in reference to FIGS. 4A-4F. An example conductance measurement resource can be configured to perform a pressure measurement process and, for purposes of description, a "subject PVEC region." will be used as an example measurement subject. The measurement process can include, for example, supplying a measurement voltage Vdd to the trace connection end of the first pad connection trace 406A that connects to the first contact pad 404A of the subject PVEC region. The measurement process can also include, having a concurrence or overlap in time with supplying Vdd, connecting of a resistive path to ground to the trace connector end of the second pad connection trace 406B that connects to the second contact pad 404B of the subject PVEC region. Since the subject PVEC region provides a conductive path between the subject PVEC region's first and second contact pads 404A, 404B, the supplied Vdd and path to resistive ground can cause a measurement current to flow, from the Vdd supply, through the subject PVEC region, and to the resistive path. The magnitude of the measurement current and the resistance of the resistive path to ground, in combination, can produce a measurement voltage, which can be sampled by the measurement resource. The measurement resource can convert the measurement to a pressure measurement, using, for example, a current-to-pressure mapping, based, for example, on a pressure versus current calibration measurement of the PVEC regions.

Figure 6A:
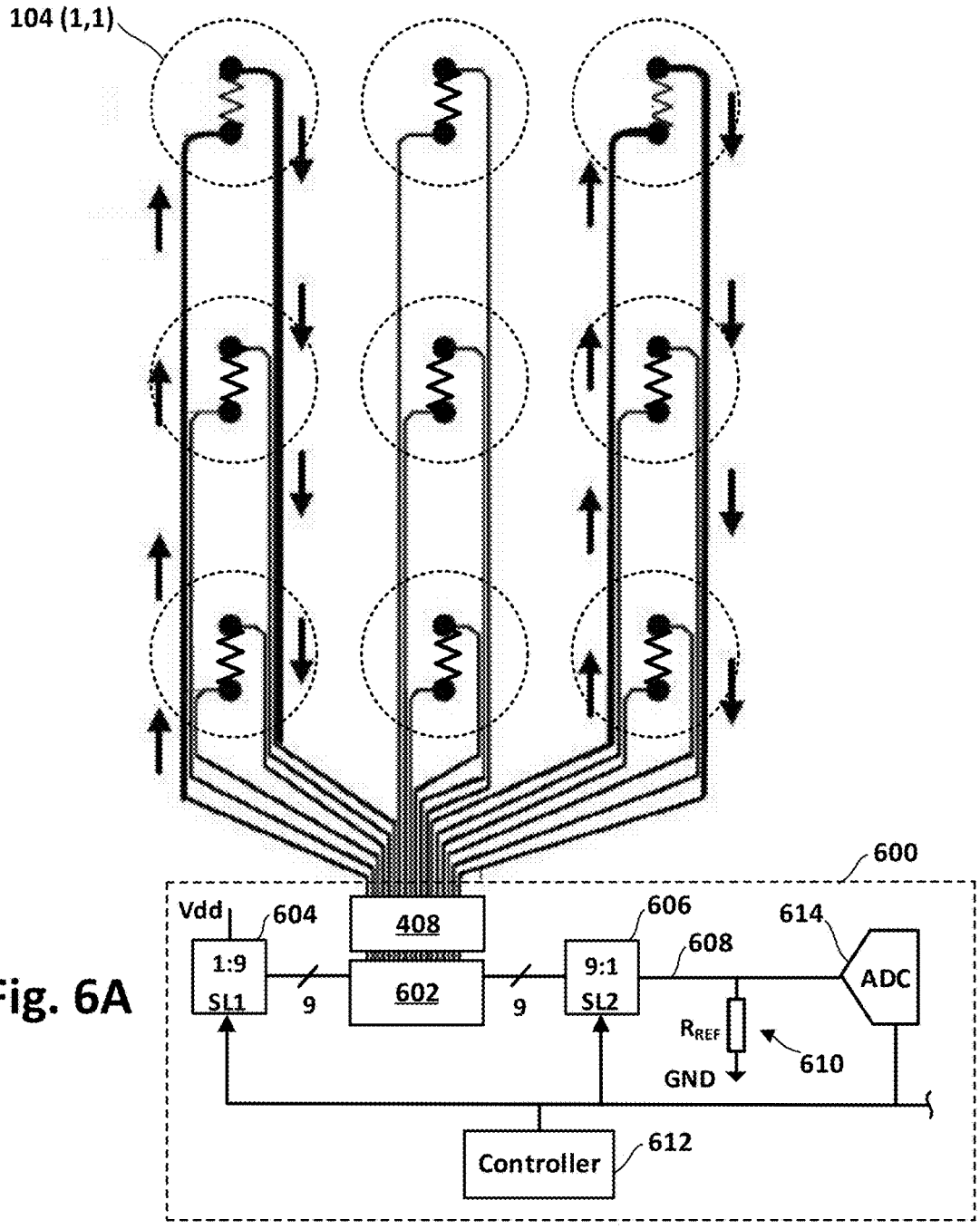
FIG. 6A shows a schematic of an example multi-area pressure monitoring circuit one-side CPT multi-area PVEC conductance measurement coupling to which the monitor circuit connects, the coupling being integrated with a functionalized CNM PVEC cushion.
Figure 6B:
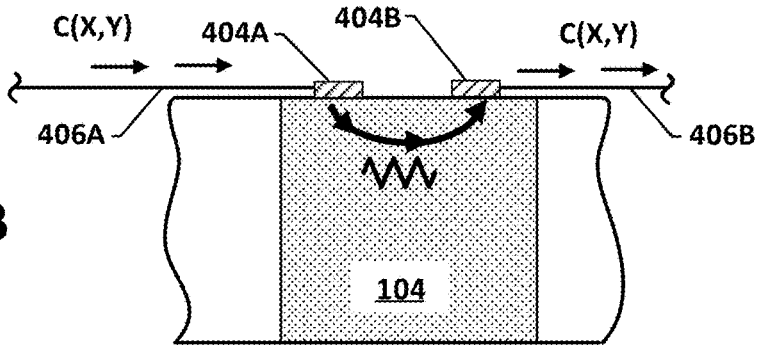
FIG. 6B is a cross-cut diagram of one of the FIG. 6A functionalized CNM PVEC cushion's PVEC regions, with an overlaying diagram of the region's conductance and of pressure-indicative measurement current through the conductance.

FIG. 6A shows a schematic of an example multi-area pressure monitoring circuit 600, connected to an integration of the FIG. 4C example one-sided CPT multi-area PVEC conductance measurement coupling 400C and an illustrative row-column PVEC array functionalized CNM PVEC cushion.

Figure 1B:
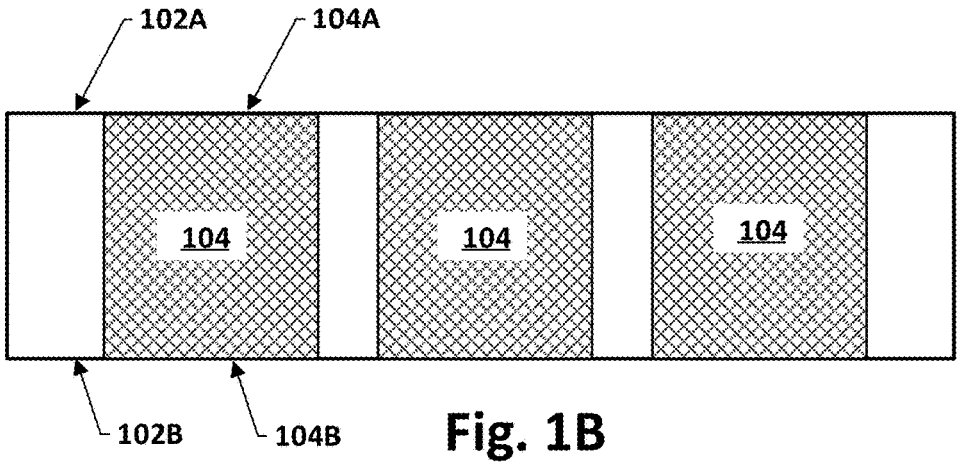
FIG. 1B shows a cross-cut diagram of the FIG. 1A structure, on the projection 1B-1B.

For purposes of description, FIG. 6A uses the FIG. 1A-1B example 3×3 row-column PVEC region functionalized CNM PVEC cushion. The FIG. 1A-1B example is not intended as any limitation on practices according to disclosed embodiments. Persons of ordinary skill in the pertinent arts, having possession of the present disclosure, can readily adapt logic architecture and functionalities shown by the multi-area pressure monitoring circuit 600 to measuring or monitoring PVEC region-specific conductance, and hence cushion pressure, for many arrangements and distributions of PCEV regions. Examples include, but are not limited to, functionalized CNM cushions with the entire cushion PVEC functionalized, PVEC regions distributed in arrangements other than row-column, and well-type 3D PVEC regions having a PVEC surface area on only one surface the cushion, e.g., the top surface.

The example multi-area pressure monitoring circuit 600 can include a measurement coupling 602, and its functionalities can include 1:1 coupling, e.g., through the FIG. 4C trace connecting tab 408, of each of integer 9 outputs of a 1:9 multiplexer (mux) 604 to a trace connection end of a corresponding one of the 9 first pad connection traces 406. Measurement coupling 602 functionality can also include 1:1 coupling of the trace connection end of each second pad connection traces 406B to a corresponding one of 9 inputs of a 9:1 selector 606.

In an embodiment, the input of the 1:9 mux 604 can connect to a measurement voltage Vdd, and the output of the 9:1 selector 606 can couple, e.g., via line 608, to a ground path resistor 610 to a reference ground. The 1:9 mux 604 can be configured to receive, e.g., from a controller logic 612 a mux control signal SL1 and, in response, connect the Vdd input to the SL1 indicated one of the 1:9 mux 604 outputs. The 9:1 selector 606 can be configured to receive, e.g., from the controller logic 612, a selector control signal SL2 and, in response, connect the SL2 indicated one of the selector 606 inputs to the resistive path 610 (to ground. Accordingly, since the first pad connection traces 406A connect 1:1 to the first contact pads 404A, and second pad connection traces 406B connect 1:1 to the second contact pads 404B, the controller logic 612, via SL1 and SL2, can cause a conductance measurement current through any selected one of the instant example's 9 PVEC regions.

To measure conductance of any subject PVEC region 104, the controller logic 612 generates a subject row-column specific SL1. SL2. The subject row-column specific SL1 causes the 1:9 mux 604 to connect Vdd to the mux 604 output that connects to the first conductive line 406A feeding the subject PVEC region first contact pad 404A. The subject row-column specific SL2 causes, concurrently, the 9:1 selector 606 to provide the ground path resistor 610 to ground to the selector input 602 fed by the second line 406B that connects to the second contact pad 404B of the subject PVEC region. Since the subject PVEC region is conductive, a measurement current flows from the SL1-selected mux 604 output through the subject first pad connection trace 406A, to the subject first contact pad 404A, through the subject PVEC region 104, to the subject second contact pad 404B, through the subject second conductive line 406B, and into the SL2 selected input of the selector 606, and, via line 608 and the ground path resistor 610 to ground. The ground path resistor 610 causes voltage on line 608, which is sampled by an analog-to-digital (ADC) converter 614.

Example 3—Functionalized CNM PVEC Pressure Monitoring Cushion with Integrated Two-Sided CPT Row-Column Multi PVEC Region Conductance Measurement Coupler According to One or More Embodiments Apparatuses according to further embodiments can include a row-column 3D PVEC region functionalized CNM PVEC cushion, having a top, upper, or first (collectively "upper") surface and a bottom, lower, or second (collectively "lower") surface. Each 3D PVEC region in the row-column array 3D PVEC can extend from a PVEC upper surface area on the upper surface to a PVEC lower surface area on the lower surface. It will be understood that for purposes of this description the assignment of which direction is "row." and which is "column" can be arbitrary.

Apparatuses according to such embodiments include, integrated on one among the upper and lower surface of the row-column PVEC functionalized CNM PVEC can be an example CPT row-linking one-side component of an example two-sided CPT PVEC measurement coupler, and integrated on the other among the upper and lower surface can be an example CPT column-linking one-side component of the example two-sided CPT PVEC measurement coupler. Description for this example arbitrarily assumes integration of the CPT column-linking one-side component on the upper surface and the CPT row-linking one-side component on the lower surface.

Figure 7A:
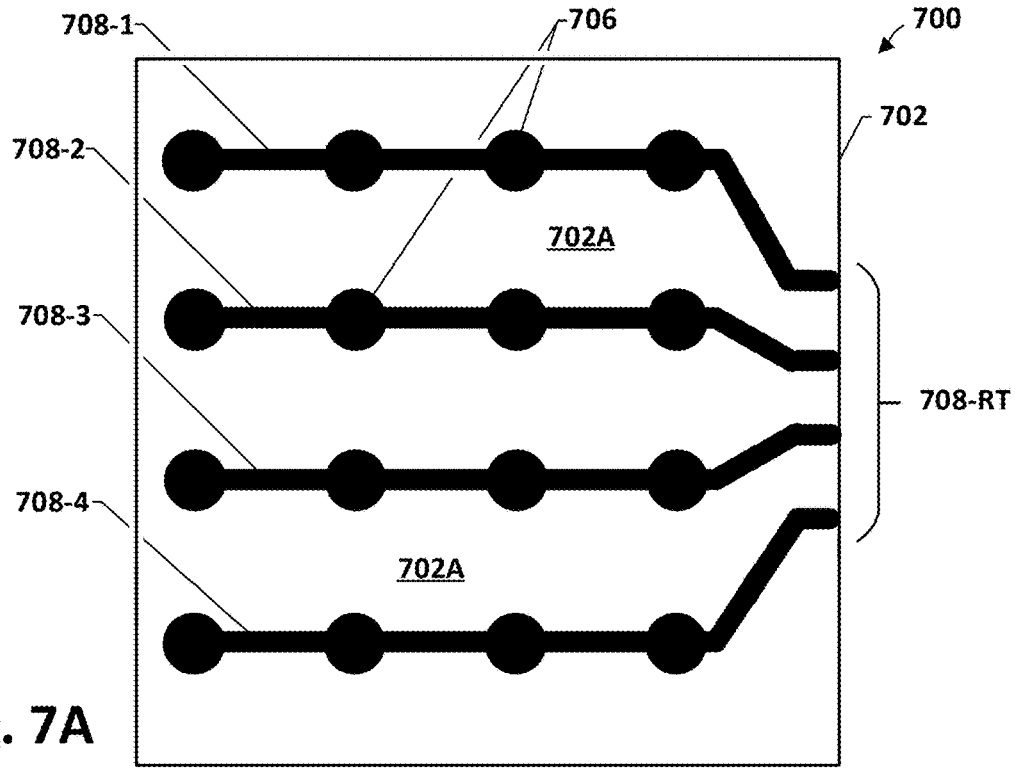
FIG. 7A shows an in-process orientation view of a conductor pattern of a CPT PVEC row coupler side of an example CPT multi-area PVEC conductance measurement coupling according to one or more two-sided embodiments.
Figure 7B:
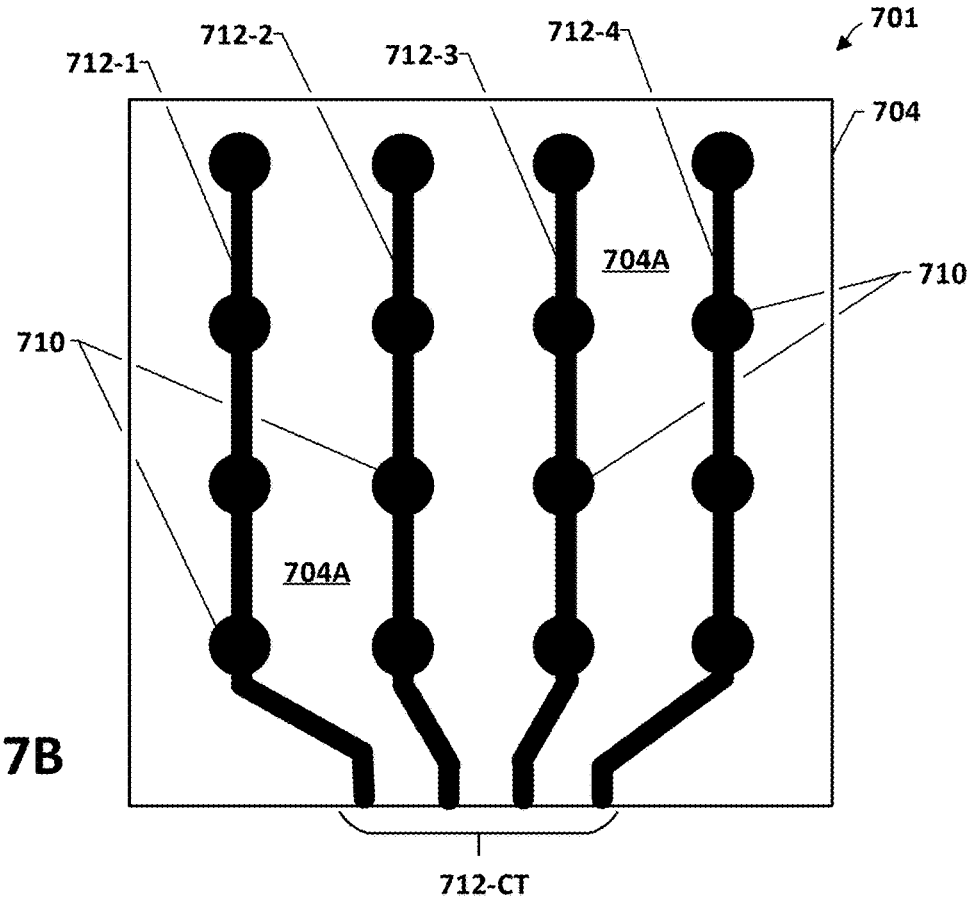
FIG. 7B shows an in-process orientation view of a conductor pattern of a CPT PVEC column coupler side of the example CPT multi-area PVEC conductance measurement coupling according to one or more two-sided embodiments.

Structural features and process operations in forming an example CPT row-linking one-side component and an example CPT column-linking one-side component of an example two-sided CPT PVEC measurement coupler are described in more detail in reference to FIGS. 7A and 7B. An example integration the FIG. 7A-7B two-sided CPT PVEC measurement coupler with a row-column 4×4 array PVEC region functionalized CNM PVEC cushion is described in reference to FIGS. 7C and 7D. An example pressure monitoring system, with a PVEC conductance measurement circuitry coupled to the FIG. 7C-7D row-column 4×4 array PVEC region functionalized CNM PVEC cushion is descried in reference to FIGS. 8A-8B.

FIG. 7A shows a conductor layout, on an underside 702A of a thermoplastic film 702, of a 4 column by 4-row example CPT row-linking one-side component of an example two-side CPT PVEC measurement coupler in accordance with various embodiments. FIG. 7B shows a printed conductive ink layout, on an underside 704A of a thermoplastic film 704 of a CPT column-linking one-side component of the example two-side CPT PVEC measurement coupler in accordance with various embodiments. For purposes of description, the thermoplastic film 702 and with complete conductive ink printing according to the FIG. 7A printed conductive ink layout will be alternatively referenced as "FIG. 7A row-linking one-side component" and as "FIG. 7A row-linking one-side component of the FIG. 7A-7B two-sided CPT PVEC measurement coupler." In like manner, the thermoplastic film 704 and with complete conductive ink printing according to the FIG. 7B printed conductive ink layout will be alternatively referenced as "FIG. 7B column-linking one-side component" and as "FIG. 7B column-linking one-side component of the FIG. 7A-7B two-sided CPT PVEC measurement coupler."

Conductive elements of the FIG. 7A row-linking one-side component 700 include a 4×4 row-column array of row contact pads, generically numbered as item 706, and generically referenced herein as "row contact pads 706." The FIG. 7A conductive elements also include a first row link 708-1, which electrically links the 4 row contact pads 706 in the top or first row the array The FIG. 7A conductive elements also include a second row link 708-2, third row link 708-3, and fourth row link 708-4, which respectively link the 4 row contact pads 706 in the second row, the 4 row contact pads 706 in the third row, and the 4 row contact pads 706 in the fourth row of the row contact pad 706 array.

Conductive elements of the FIG. 7B column-linking one-side component 701 include a 4×4 row-column array of column contact pads, generically numbered as item 710, and generically referenced herein as "column contact pads 710." The FIG. 7B conductive elements also include a first column link 712-1, which electrically links the 4 column contact pads 710 in the first column of the column contact pad 710 array, and include a second column link 712-2, third column link 712-3, and fourth column link 712-4, which respectively link the 4 column contact pads 710 in the second column, the 4 column contact pads 712 in the third column, and the 4 column contact pads 706 in the fourth column of the column contact pad 710 array.

Figure 7C:
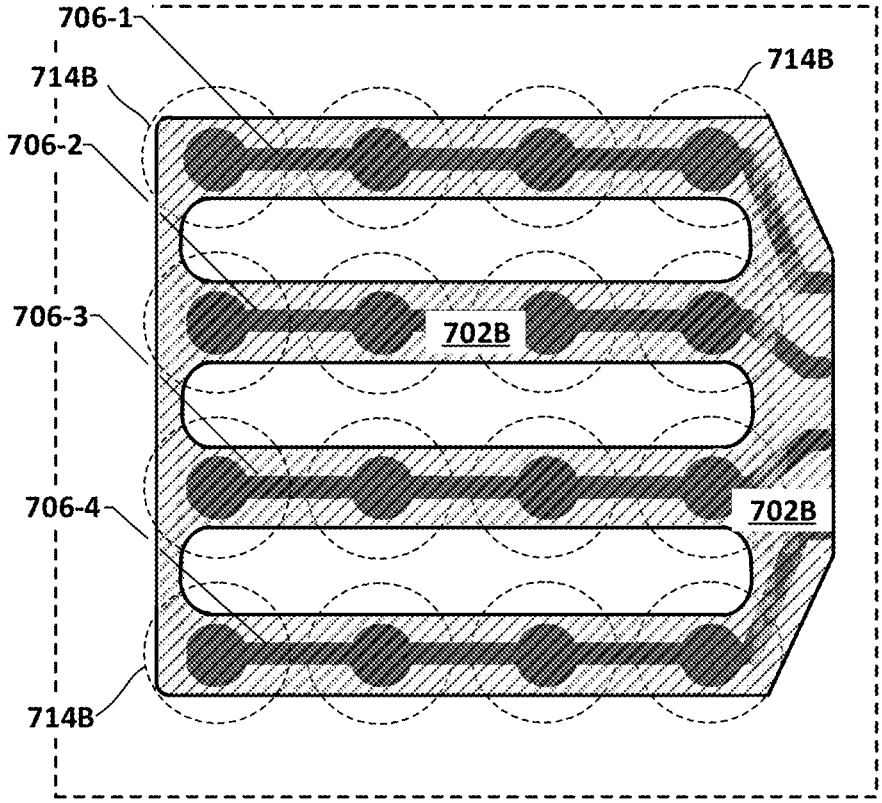
FIG. 7C shows a heat seal integration, with a top surface of a PVEC row-column array functionalized CNM PVEC cushion, of an optionally trimmed version of the FIG. 7A CPT PVEC row coupler side of the example CPT multi-area PVEC conductance measurement coupling.

FIG. 7C shows a heat seal integration, with PVEC lower surface areas 714B on a lower surface of a PVEC 4×4 row-column array functionalized CNM PVEC cushion, of an optionally trimmed version of the FIG. 7A one side CPT PVEC row coupler side. As shown, the second side 702B of the thermoplastic film 702 is facing up, i.e., away from the lower surface of the functionalized CNM PVEC cushion, and the underside 702A (not directly visible in FIG. 7C) faces toward the cushion's lower surface.

Figure 7D:
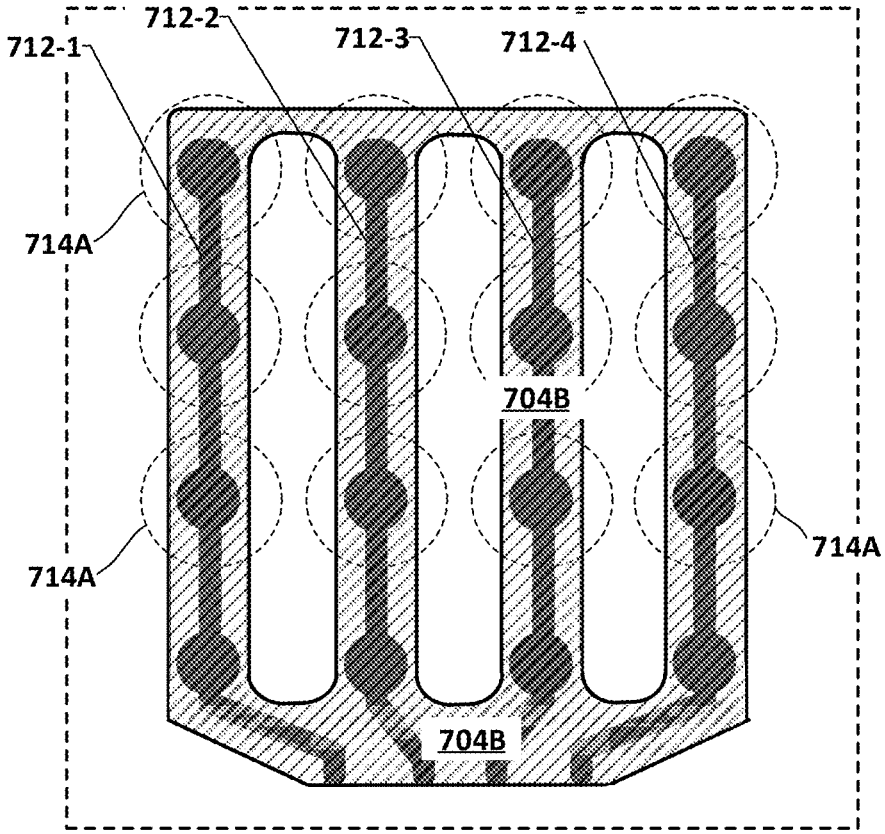
FIG. 7D shows a heat seal integration, with the bottom surface of the PVEC row-column array functionalized CNM PVEC cushion, of an optionally trimmed version of the FIG. 7B CPT PVEC column coupler side of the example CPT multi-area PVEC conductance measurement coupling.

FIG. 7D shows a heat seal integration, with PVEC upper surface areas 714A on an upper surface of the PVEC 4×4 row-column array functionalized CNM PVEC cushion, of an optionally trimmed version of the FIG. 7B one side CPT PVEC column coupler side. As shown, the second side 704B of the thermoplastic film 704 is facing up, i.e., away from the upper surface of the functionalized CNM PVEC cushion, and the underside 704A (not directly visible in FIG. 7C) faces toward the cushion's upper surface.

Figure 8A:
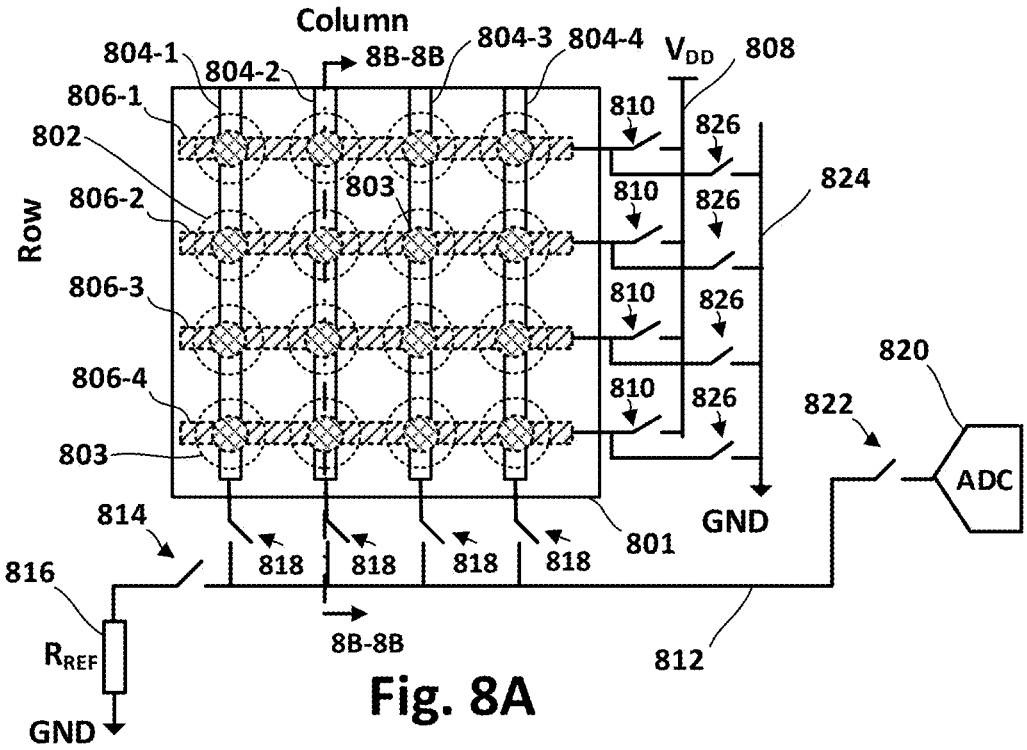
FIG. 8A shows a schematic of an example multi-area pressure monitoring circuit, connected to the FIG. 7C-7D example two-sided CPT multi-area PVEC conductance measurement coupling, integrated with the example PVEC row-column array functionalized CNM PVEC cushion.
Figure 8B:
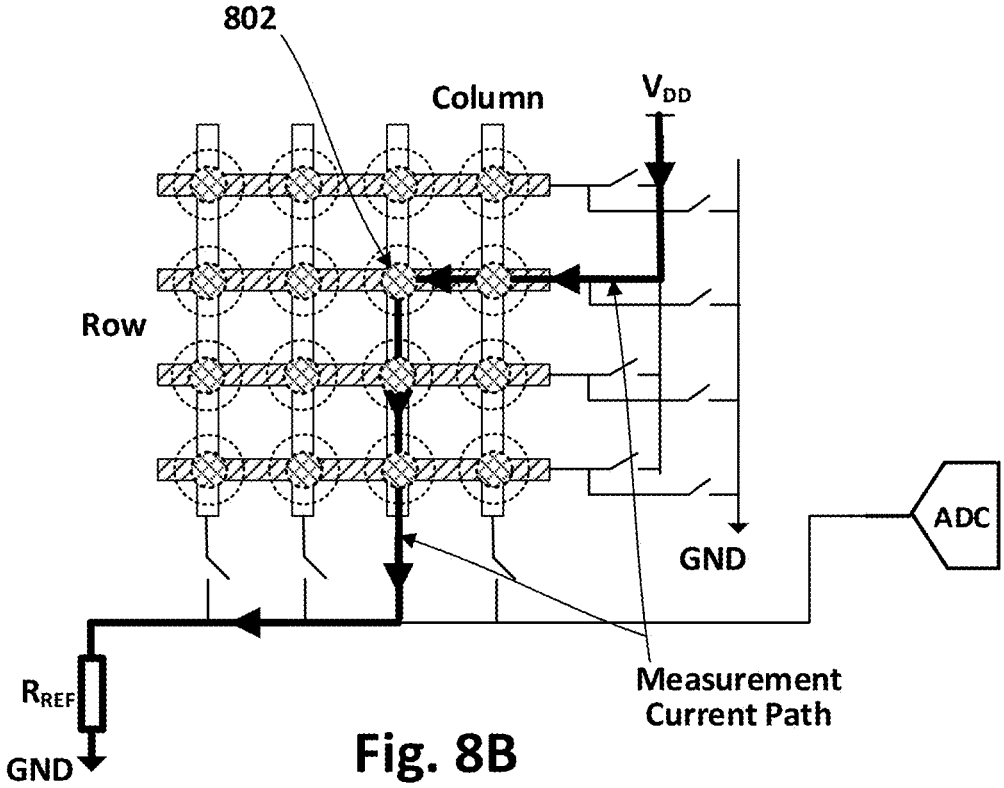
FIG. 8B shows the FIG. 8A schematic with overlaying markings of measurement current flows.

Referring to FIGS. 8A and 8B, an example pressure monitoring system, with a PVEC conductance measurement circuitry coupled to the FIG. 7C-7D row-column 4×4 array PVEC region functionalized CNM PVEC will be described.

FIG. 8A is a top view diagram of an example functionalized CNM PVEC cushion 801, including 4-row×4-column array of 3D columnar CNM PVEC regions 802. The 4×4 row-column dimension and the population of 16 3D columnar CNM PVEC regions 802 are for purposes of example and not intended as indication of preference, or as limitation of the scope of practices in accordance with disclosed embodiments.

The CNM PVEC cushion 801 is further functionalized as an integrated pressure sensing functionalized CNM PVEC cushion 801 by integration, on its lower surface, of a CPT row-linking side of a two-sided CPT PVEC array measurement coupler and, on its upper surface, a CPT column-linking side of the two-sided CPT PVEC array measurement coupler. FIG. 8A is a projection of the upper surface and, therefore perspective, only the column-linking side of the two-sided conductive ink CPT PVEC array measurement coupler is visible. Figure lines are therefore solid for the column coupling links 804-1, 804-2, 804-3, and 804-4 (and hidden-line dotted for the row coupling links 806-1, 806-2, 806-3, and 806-4.

The FIG. 8A-8B measurement circuit includes "VDD" power rail 808, an individual row coupling link 806, a row GNR rail 810 provided for each row coupling link 806, and an individual VDD coupling switch 812. The FIG. 8A-8B example also includes a column reference rail 812 that is switchably connected, via column reference coupling switch 814, to a reference resistor 816 that connects to GND. Each of the 4 column coupling links 804 is provided an individual column-specific reference rail coupling switch 818, for switchable coupling to the column reference rail 812. In accordance with one or more embodiments, the example can include an analog-to-digital converter (ADC) 820, which can be switchably coupled to the column reference line 812, via ADC coupling switch 822.

Referring to FIG. 8B, operations in an example instance of measuring the conductance of selectable one of the PVEC regions will be described. The subject PVEC region, which is arbitrarily selected, is the one with item number "803" on FIG. 8A. Operations can include connecting VDD to the second row coupling link 806-2, by switching ON the row-specific VDD coupling switch 810 for element 806-2. Operations also include connecting the third column coupling link 804-3 to the column reference rail 812, and connecting the column reference rail 812, via the reference resistor 816, to ground. In this example these operations can be provided by switching ON the column reference coupling switch 814, and switching ON the column-specific reference rail coupling switch 818 that connects the third column coupling link 804-3 to the column reference rail 812. Measurement operations can further include connecting the ADC 820 to the column reference rail 812, by switching ON the ADC coupling switch 822. The resulting measurement current path is labeled and highlighted in bold line on FIG. 8B.

The magnitude of the current carried by the measurement current path can be fully determined by the specific present numerical value of the voltage VDD, the present conductance (i.e., inverse of resistance) of the functionalized columnar CNM PVEC region 803 summed with other resistance in the serial path from the VDD source to ground, e.g., resistance of the second row coupling link VDD switch 810, resistance of the second row coupling link 806-2, resistance of the third column coupling link 804-3, resistance of the column-specific reference rail coupling switch 818 for the third column coupling link 804-3, and resistance of the reference resistor 816.

The arrangement described in FIGS. 8A-8B can be practiced with larger arrays the 4×4, arrays that do not have the same number of columns and rows, or any other configuration. The important feature is that in-place functionalized columnar CNM PVEC cushion device 902 has an array of instantiated conductive columns, each of which can be separately and or simultaneously sensed, depending on the desired application.

Figure 9A:
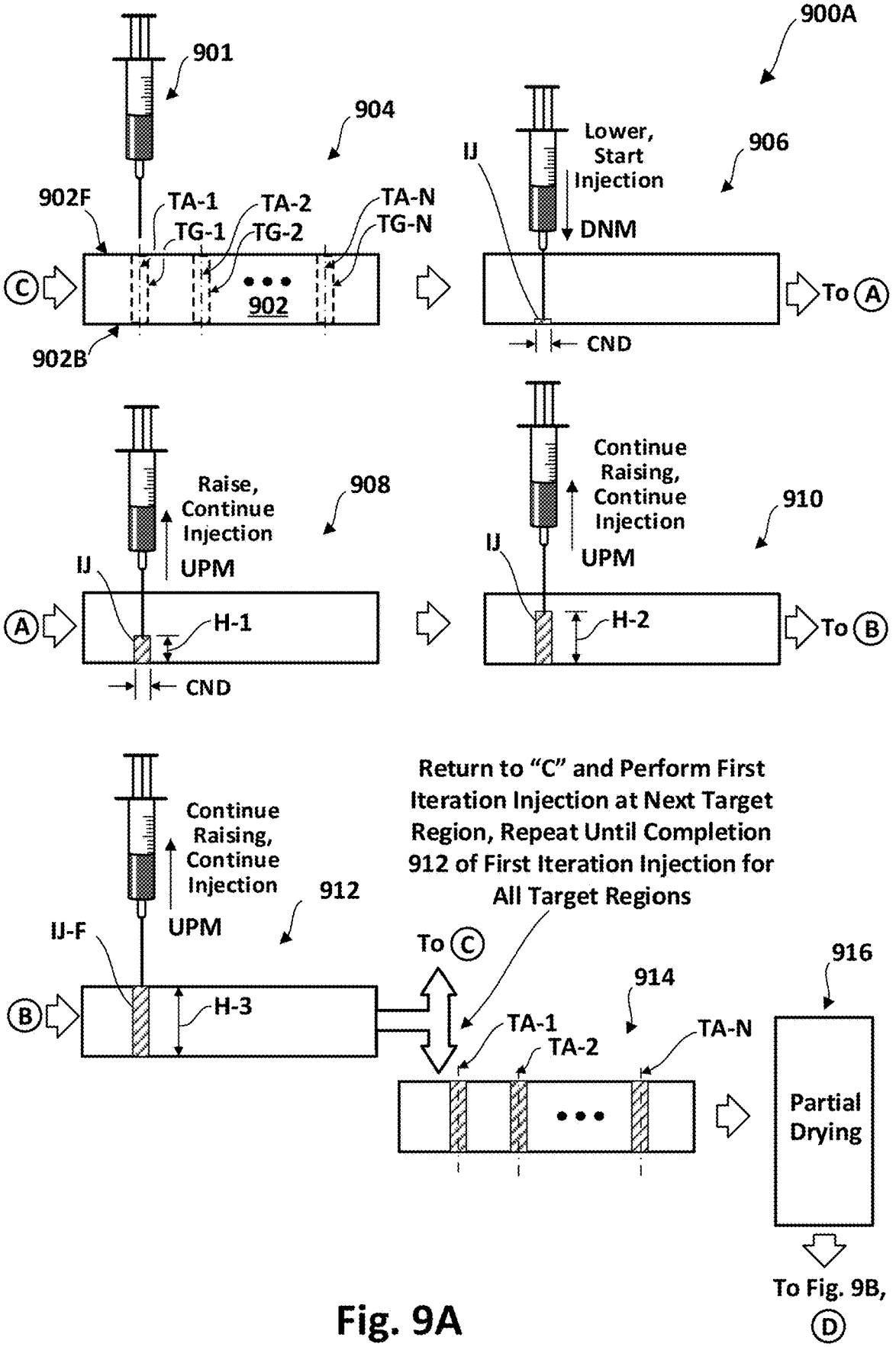
FIG. 9A shows a diagram of a process flow in first stage injection and partial drying of a liquid suspended conductive polymer in a process according to various embodiments of in-place functionalizing a CNM cushion with 3D CNM PVEC regions.
Figure 9B:
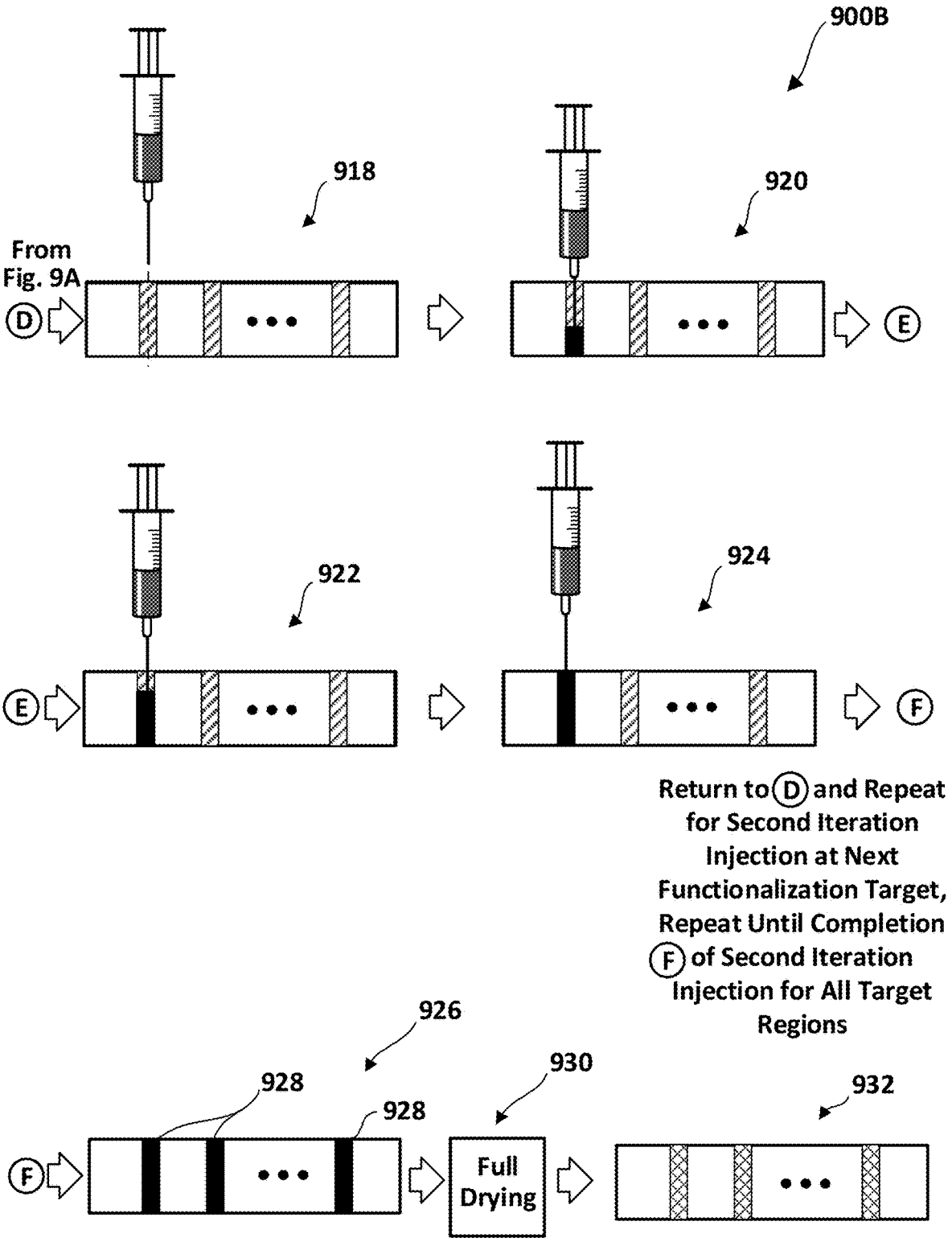
FIG. 9B shows a diagram of a process flow in second stage injection of liquid suspended conductive polymer and final drying homogenizing, forming according to various embodiments a functionalized CNM PVEC cushion with 3D columnar PVEC regions.

Example 4—Example Two-Pass Process for Functionalizing CNM Cushions with One or More PVEC Regions FIGS. 9A and 9B show, respectively, a process first pass flow diagram 900A and a process second pass flow diagram 900B for a two-pass in-place PVEC functionalization process in accordance with one or more embodiments. Example two-pass processes in accordance with FIGS. 9A and 9B, hereinafter collectively referenced as "two-pass CNM PVEC functionalization 900," which can functionalize a plurality, e.g., a row-column array, or other distribution of 3D target regions of a CNM cushion into a corresponding plurality of in-place functionalized 3D CNM PVEC regions. Features of process portions according to the first pass flow diagram 900A can include, for each of N target regions TG-1. TG-2 . . . . TG-N a first iteration, vertically upward progressive injection IJ of liquid suspension conductive polymer, starting at 906, continuing to height H1 at 908, height H2 at 910, and producing at 912, for each, a first iteration full height H3 3D columnar distribution IJ-F of liquid suspension conductive polymer. After N loop, the process portion is at 914, from which it can proceed to partial drying 916. The partial drying 916 can form a plurality, e.g., array of integer N in-progress columnar distributions of not fully dried conducting polymer.

The FIG. 9A abstracted medical syringe representation of the injection nozzle 901 is not intended as any limitation, or as any indication or statement of preference as to structure or other specifications regarding implementation of the injection nozzle 101. Example implementation of the injection nozzle 901, for practices in accordance with various embodiments, can include, but are not limited to, industrial injection nozzles that can be actuated, for example, by a robotic arm.

Features of process portions according to the second pass flow diagram 900B can include, for each of the integer N first pass flow 900A produced columnar distribution of not fully dried conducting polymer, a second iteration injection of liquid suspension conductive polymer followed by a full drying to produce integer N 3D columnar PVEC regions. Second iteration injection can but does not necessarily use the same injection nozzle 901 used for the first iteration injection.

Referring to FIG. 9B, an example instance of a first iteration injection process can begin at a state 918 with the tip of injection nozzle 901 spaced above the top surface 902F or the CNM cushion 902 aligned with the first columnar axis TA-1 of the first columnar target region TG-1. The flow can then proceed to process state 920 by lowering the tip of injection nozzle 901 to a height, for example, at or approximately at the back surface 902B, proceed with injection and commence upward vertical movement in alignment with the first columnar axis TA-1. In an embodiment, the injection and upward vertical movement of the injection nozzle 901 can continue, through states 920 and 922 until reaching full height at 924. The loop 918, 920, 922, 924 can repeat N times, whereupon the process can be at state 926, with a full, homogenized 3D columnar distribution 928 of not-solidified conductive polymer. The process can then proceed to full drying 930 that can form integer N 3D columnar PVEC regions.

Figure 10:
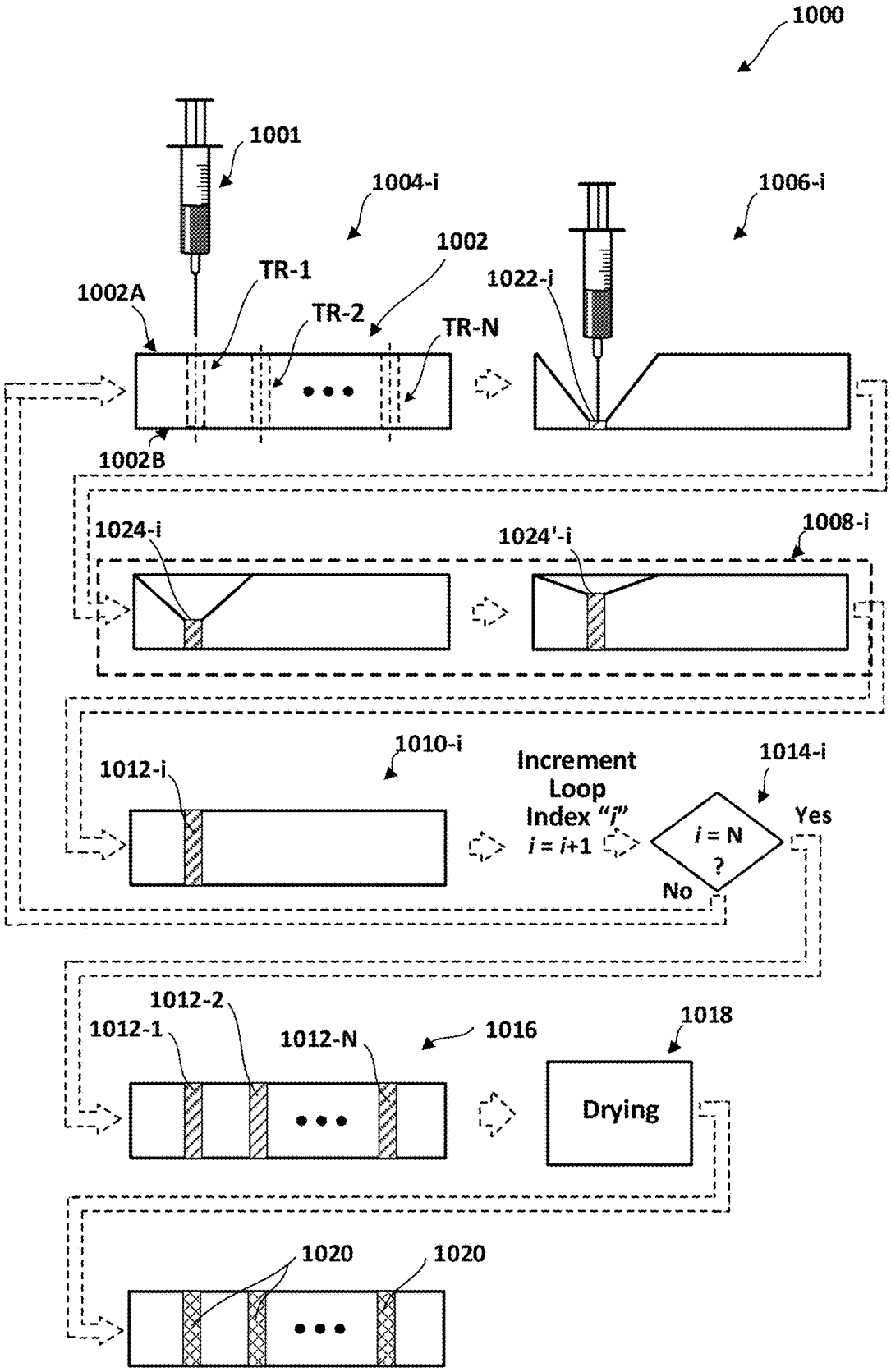
FIG. 10 shows a diagram of a process flow in single-pass functionalization of a PNM cushion process in one or more embodiments.

Example 5—Example One-Pass Process for Functionalizing CNM Cushions with One or More PVEC Regions FIG. 10 is a flow diagram of an example implementation 1000 of a single-pass in place CNM PVEC functionalization process according to various embodiments. In overview, implementation (hereinafter "flow 1000"), starts with a CNM cushion 1002, e.g., a CNM mattress in which a plurality, e . . . , integer N 3D columnar target regions TR-i, i=1 to N (generically "target regions TR"), are to be functionalized as 3D columnar PVEC regions. A sequence of process steps, represented in FIG. 10 by a snapshot sequence 1004-*i*, 1006-*i*, 1008-*i*, and 1010*i*, each described in more detail in subsequent paragraphs, is repeated N times, each repeat establishing within another of the target regions TR a columnar distribution 1012-*i* of non-solidified conductive polymer. As shown by "increment loop index 'i' by one" and conditional branch 1014-*i* that succeed state 1010-*i*, the sequence 1004-*i*, 1006-*i*, 1008-*i*, and 1010*i* repeats until N columnar distributions 1012 are formed. When N columnar distributions 1012 are formed the flow 1000 s at state 1016, from which the flow 1000 can proceed to a drying 1018, configured to solidify the N columnar distributions 1012-*i* of non-solidified conductive polymer, forming N 3D columnar PVEC regions 1020. As shown in FIG. 10 each 3D columnar PVEC region 1020 can extend through the CNM cushion 1002, from a PVEC first or top surface area (visible in FIG. 10 but not separately numbered) on the top surface 1002A of the cushion (hereinafter "cushion top surface 1002A") to a PVEC bottom or second surface area (visible in FIG. 10 but not separately numbered) on the bottom surface 1002B of the cushion (hereinafter "cushion bottom surface 1002B")

Referring to FIG. 10, in process state 1006-*i* the injection nozzle 1001 is positioned, e.g., by a robotic manipulator, above cushion top surface 1002A, aligned to the column axis (visible but not separately numbered) of target region TR-i. The flow 1000 can proceed from state 1004-*i* to process state 1006-*i* by steps of applying pressure, preferably focused within the perimeter of the target region TR-i, compressing the CNM originally occupying target region TR-i against a processing support (not visible in FIG. 10) under the cushion bottom surface 1002B to achieve processing state 1006-*i*. The compression can be configured to produce a compressed CNM portion 1020-*i*, having a volume much less than the volume of the target region TR-i. Operations reaching processing state 1006-*i* can include, as visible in FIG. 10, positioning an injection tip of the injection nozzle 1001 into the compressed CNM portion 1022-*i*, and injecting a volume of liquid suspension conductive polymer into the compressed portion 1022-*i*. The flow 1000 can proceed from the injecting to releasing the compressed portion 1020-*i*, allowing the compressed CNM to self-expand 1008-*i*, in part due to the resiliency characteristic of the CNM, to an intermediate expansion state 1024, and continuing to a further expansion state 1024' and then to a full expansion state forming the columnar distribution 1012-*i*, occupying the original TR-i region.

Figure 11:
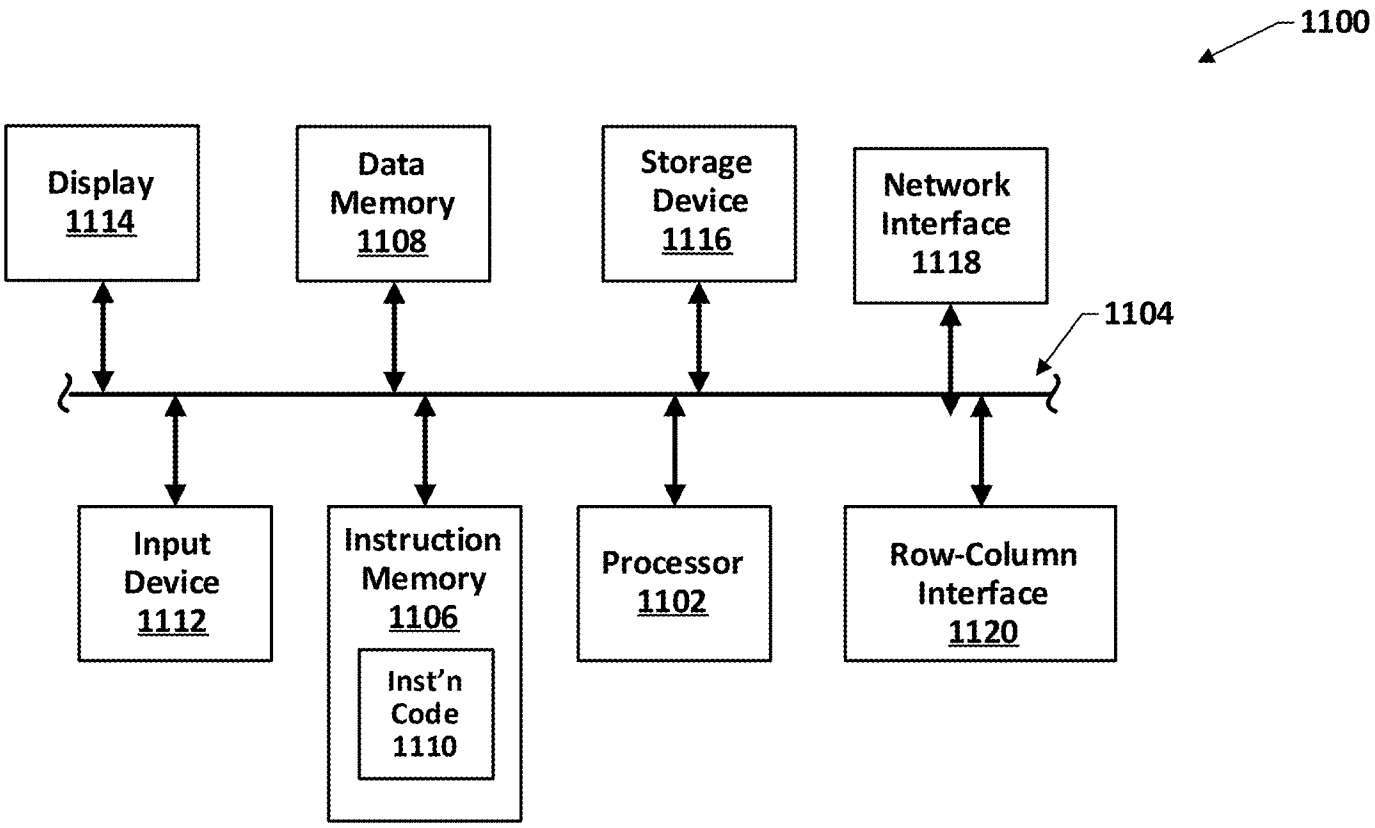
FIG. 11 shows a logic schematic of an example programmable processor device on which various example systems and methods in accordance with one more disclosed embodiments can be practiced.

FIG. 11 shows a logic schematic of an example computing system 1100 on which various example systems and methods in accordance with one more disclosed embodiments can be practiced. The computer system 1100 can include a hardware processor 1102 communicatively coupled, e.g., by a bus 1104 to an instruction memory 1106 and to a data memory 1108. The instruction memory 1106 can be configured to store, on at least a non-transitory computer readable medium as described in further detail below, executable program code 1110. The hardware processor 1102 may include multiple hardware processors and/or multiple processor cores. The hardware processor 1102 may include hardware processors from different devices, that cooperate. The computer system 1100 system may execute one or more basic instructions included in the executable program code 1110. The computer system 1100 may include a user input 1112, e.g., a keyboard, touchpad, voice-interaction resource, and may include a display 1114. The computer system 1100 may include a large capacity local storage, shown a "storage device 1116, and may include a network interface 1118. The network interface 1118 can, for example include a TCP/IP capability, and capability of intaking an Internet Service Provider (ISP). The computer system 1100 can include a row-column interface, interfacing to the row-column multiplexer, A/D converter, and switch controller described, for example, in reference to FIGS. 9A-9C A computer program product is an article of manufacture that has a computer-readable medium with executable program code that is adapted to enable a processing system to perform various operations and actions. A computer-readable medium may be transitory or non-transitory. Non-transitory computer-readable media may be understood as a storage for the executable program code. Non-transitory computer-readable media may hold the software in its entirety, and for longer duration, compared to transitory computer-readable media that holds only a portion of the software and for a relatively short time. The term, "non-transitory computer-readable medium," specifically excludes communication signals such as radio frequency signals in transit. Examples of on-transitory computer-readable media: include removable storage such as a universal serial bus (USB) disk, a USB stick, a flash disk, a flash drive, a thumb drive, an external solid-state storage device (SSD), a compact flash card, a secure digital (SD) card, a diskette, a tape, a compact disc, an optical disc; secondary storage such as an internal hard drive, an internal SSD, internal flash memory, internal non-volatile memory, internal dynamic random-access memory (DRAM), read-only memory (ROM), random-access memory (RAM), and the like; and the primary storage of a computer system.

In various embodiments, the CNM can be a vertically lapped ("VLAP") nonwoven material which can be formed, for example, with methods described in U.S. Publication 2008/0155787 and U.S. Pat. No. 7,591,049, each of which is incorporated herein by reference. VLAP nonwovens are commercially available from various commercial vendors. Features of in-place functionalization processes in accordance with one or more embodiments can include, but are not limited to, forming the devices with mutual alignment of the column axes and the VLAP fiber orientation, with one another and normal to the front and back surfaces of the VLAP cushion.

As discussed above, in-place functionalizing processes according to various embodiments can include a sub-process of forming within the 3D target region of the CNM cushion a columnar distribution of non-solidified conductive polymer, and can include a sub-process of converting the columnar distribution of non-solidified conductive polymer into a columnar shaped in-place instantiated CNM PVEC device. The converting process in accordance with one or more embodiments can comprise a drying or curing of the distribution of non-solidified conductive polymer through, for example, the application of heat or radiant energy. According to various embodiments, operations and materials in the sub-process of forming within the CNM cushion the columnar distribution of non-solidified conductive polymer and operations in the sub-process of converting the distribution can be mutually configured to form the columnar shaped in-place functionalized CNM PVEC device with particular structural features. In one or more embodiments, these structural features can include mutually separated portions or collections of solidified conductive polymer, respectively supported by mutually separated flexible fibers of the nonwoven, e.g., VLAP nonwoven or otherwise. These structural features, in combination, provide characteristics of the pressure-varying electrical conductance of the columnar shaped in-place functionalized CNM cushion device.

In an embodiment, the forming the columnar distribution of non-solidified conductive polymer can comprise an injecting process, which can include injecting into at least a portion of the 3D target region a liquid carrying conductive polymer in suspension. Examples can include, but are not limited to, poly(3,4-ethylenedioxythiophene) polystyrene sulfonate (PEDOT:PSS), poly(6-(thiophene-3-yl) hexan-1-sulfonate (PTHS), polyaniline, polypyrrole, polythiophene and polyfuran, each of which are available from various commercial vendors. Aqueous solutions carrying PEDOT:PSS, can be used, such as CLEVIOS™ PH 1000, CLEVIOS™ F 010, CLEVIOS™ F ET available from Heracus GmbH. In some applications, the conductive polymer can form all or part of the conductive ink used on the PVEC measuring coupler.

Figure 2:
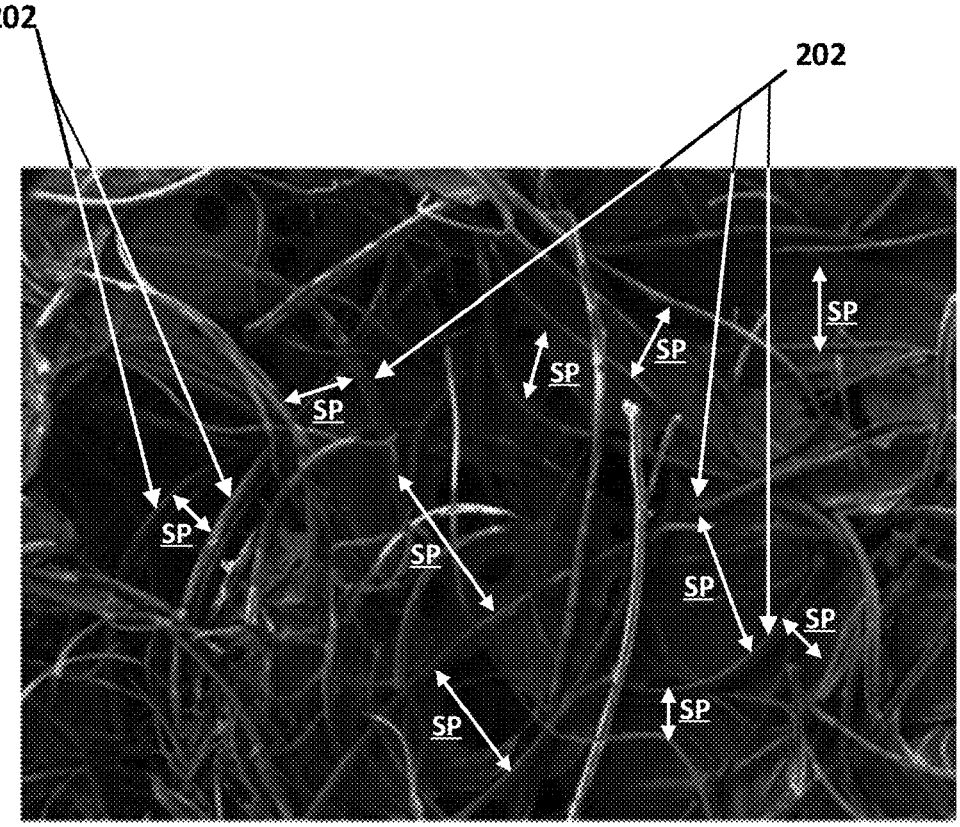
FIG. 2 shows a scanning electron microscope (SEM) image of a region of the FIG. 2A structure.

FIG. 2A shows a perspective view photo image of a columnar in-place functionalized VLAP PVEC cushion device, cut from a VLAP cushion after formation.

FIG. 2B shows a scanning electron microscope (SEM) image of a region of the FIG. 2A structure. Referring to FIG. 2B, in a feature of functionalization processes such as described in reference to FIGS. 1A and 1B, drying of the distribution of non-solidified conductive polymer can obtain a columnar structure that changes its conductivity by collapsing the empty spaces in the material and increasing the connection points between the conductive film on the fibers. Examples of solidified conductive polymer coated VLAP fibers are labeled "202." Example spacings are labeled "SP." As can be seen from FIG. 2B, as lower pressures are applied the smaller spacings SP come into contact with one another to increase the conductivity from the top to the bottom of the column. Then, as more pressure is applied, the larger spacings SP come into contact with one another to increase the conductivity even more. In this way, the pressure at the region of a column within the VLAP PVEC cushion device can be readily detected and measured, and changes in pressure at that region can be monitored over time.

FIG. 3 shows a photo-image of a front surface of a functionalized CNM cushion 300 with a 4×4 array of CNM PVEC regions 302R. As noted above, the shape and size and number of columns of the array 302R can vary widely depending on the application.

It is noted that, as used herein and in the appended claims, the singular forms "a", "an", and "the" include plural referents unless the context clearly dictates otherwise. It is further noted that the claims may be drafted to exclude any optional element. As such, this statement is intended to serve as support for the recitation in the claims of such exclusive terminology as "solely," "only" and the like in connection with the recitation of claim elements, or use of a "negative" limitations, such as "wherein [a particular feature or element] is absent", or "except for [a particular feature or element]", or "wherein [a particular feature or element] is not present (included, etc.) . . . ".

Where a range of values is provided, it is understood that each intervening value, to the tenth of the unit of the lower limit unless the context clearly dictates otherwise, between the upper and lower limit of that range and any other stated or intervening value in that stated range, is encompassed within the invention. The upper and lower limits of these smaller ranges may independently be included in the smaller ranges and are also encompassed within the invention, subject to any specifically excluded limit in the stated range. Where the stated range includes one, or both of the limits, ranges excluding either or both of those included limits are also included in the invention.

As will be apparent to those of skill in the art upon reading this disclosure, each of the individual embodiments described and illustrated herein has discrete components and features which may be readily separated from or combined with the features of any of the other several embodiments without departing from the scope or spirit of the present invention. Any recited method can be carried out in the order of events recited or in any other order which is logically possible.

The invention is further described by the following non-limiting examples which further illustrate the invention, and are not intended, nor should they be interpreted to, limit the scope of the invention.

We claim:

1. A functionalized pressure-varying electrical conductance (PVEC) cushion with integrated PVEC coupling, comprising:

a compressible nonwoven material (CNM) cushion, having a cushion surface and a three-dimensional (3D) functionalized PVEC region that comprises CNM fibers supporting a distributed coating of conductive polymer and having a PVEC surface area on the cushion surface; and a PVEC measuring coupler, secured by an adhesion to the cushion surface, and comprising a plastic or insulative film and, on disposition areas of cushion-facing surfaces of the film, conductive ink elements, including a pair of contact pads, mutually spaced by a pad spacing, and a pair of pad connection traces, one of said pad connection traces extending from one of said contact pads to a trace terminal among a pair of trace terminals, and the other of the pad connection traces extending from the other of the contact pads to the other of said trace terminals, wherein the adhesion comprises heat sealing adhesion to the cushion surface of areas of the cushion-facing surfaces of the film outside the ink disposition areas, the pair of contact pads are in direct electrical contact with the PVEC surface area, and the PVEC measuring coupler, or the CNM cushion, or both, further comprise insulation configured to insulate the pair of pad connection traces from the PVEC surface area.

2. The functionalized PVEC cushion with integrated PVEC coupling according to claim 1, wherein:

the pair of contact pads includes a first contact pad and a second contact pad, and the pair of pad connection traces includes a first pad connection trace, extending from the first contact pad to a first trace terminal, and a second pad connection trace, extending from the second contact pad to a second trace terminal.

3. The functionalized PVEC cushion with integrated PVEC coupling according to claim 1, wherein the 3D functionalized PVEC region is a first 3D functionalized PVEC region, and the PVEC surface area is a first PVEC surface area, the pair of contact pads is a first pair of contact pads, and the pair of pad connection traces is a first pair of pad connection traces, the NWM cushion further includes a second functionalized PVEC region, having a second PVEC surface area on the cushion surface, the conductive ink conductive elements further include a second pair of contact pads, mutually spaced by a second pad spacing, and a second pair of pad connection traces, one of the pad connection traces of the second pair of pad connection traces extends from one of the contact pads of the second pair of contact pads to a trace terminal of a second pair of trace terminals, and the other of the pad connection traces of the second pair of pad connection traces extends from the other contact pad of the second pair of contact pads to the other trace terminal of the second pair of trace terminals, the second pair of contact pads is in direct electrical contact with the second PVEC surface area, and the insulation is further configured to insulate the second pair of pad connection traces from the second PVEC surface area.

4. The functionalized PVEC cushion with integrated PVEC coupling according to claim 1, wherein the compressible NWM cushion has N 3D functionalized PVEC regions, and the functionalized PVEC region is among the N 3D functionalized PVEC regions, the conductive ink elements comprise N pairs of contact pads, each mutually spaced by a corresponding pad spacing, N pairs of pad connection traces, and N pairs of trace terminals, the pair of contact pads is among the N pairs of contact pads, the pair of pad connection traces is among the N pairs of pad connection traces, and the pair of trace terminals is among the N pairs of trace terminals, each nth pair of pad connection traces among the N pairs of pad connection traces is associated with a corresponding nth pair of contact pads among the N pairs of contact pads and a corresponding nth pair of trace terminals among the N pairs of trace terminals, for each nth pair of pad connection traces pad connection traces, a pad connection trace of said pair of pad connection traces extends from a contact pad of the corresponding nth pair of contact pads to a trace terminal of the corresponding nth pair of trace terminals, and the other pad connection trace of said pair of pad connection traces extends from the other contact pad of the corresponding nth pair of contact pads to the other trace terminal of the corresponding nth pair of trace terminals, and each nth pair of contact pads is in direct electrical contact with the associated nth PVEC surface area.

5. The functionalized PVEC cushion with integrated PVEC coupling according to claim 4, wherein each of the nth pairs of contact pads includes an nth first contact pad and an nth second contact pad, each nth pair of pad connection traces includes an nth first pad connection trace and an nth second pad connection trace, and each nth pair of trace terminals includes an nth first trace terminal and an nth second trace terminal, and the functionalized PVEC cushion with integrated PVEC coupling further comprises:

a 1:N first multiplexer, configured with a first multiplexer input, N first multiplexer outputs, and a first multiplexer selection control input configured to receive a first multiplexer control signal that is switchable among N first multiplexer control states, the first multiplexer being further configured to switch to or to maintain, in response to each nth first multiplexer control state among the N first multiplexer control states, a connection of the first multiplexer input to an nth first multiplexer output among the N first multiplexer outputs, to the first multiplexer input being configured to connect to a local rail voltage;

an N:1 second multiplexer, configured with N second multiplexer inputs, a second multiplexer output, and a second multiplexer selection control input configured to receive a second multiplexer control signal that is switchable among N second multiplexer control states, the second multiplexer being further configured to switch to or to maintain, in response to each nth second multiplexer control state among the N second multiplexer control states, a connection to the second multiplexer output of an nth second multiplexer input among the N second multiplexer inputs; and a reference resistance path connecting the first multiplexer output to a ground reference.

6. The functionalized PVEC cushion with integrated PVEC coupling according to claim 1, wherein the pair of contact pads is a first pair of contact pads, the pair of pad connection traces is a first pair of pad connection traces, and the pad spacing is a first pad spacing, the conductive ink elements further include a second pair of contact pads, and a second pair of pad connection traces, the second pair of conductive contacts mutually spaced by a second pad spacing, a pad connection trace of the second pair of pad connection traces extends from a contact pad of the second pair of contact pads to a trace terminal of a second pair of trace terminals, and the other of the pad connection traces of the second pair of pad connection traces extends from the other contact pad of the second pair of contact pads to the other trace terminal of the second pair of trace terminals, the first pair of contact pads directly contacts the PVEC surface area at a respective first pair of contact locations, mutually spaced by the first pad spacing, the second pair of contact pads directly contacts the PVEC surface area at a respective second pair of contact locations, mutually spaced by the second pad spacing, the insulation is further configured to insulate the second pair of pad connection traces from the second PVEC surface area, and a reference centroid of the first pair of contact locations is a first reference centroid, a reference centroid of the second pair of contact locations is a second reference centroid, and a distance from the first reference centroid to the second reference centroid is substantially greater than a largest among the first pad spacing and second pad spacing.

7. The functionalized PVEC cushion with integrated PVEC coupling according to claim 1, wherein at least a portion of the CNM cushion includes at least one vertically lapped (VLAP) nonwoven material.

8. The functionalized PVEC cushion with integrated PVEC coupling according to claim 1, wherein the plastic or insulative film is a thermoplastic film.

9. The functionalized PVEC cushion with integrated PVEC coupling according to claim 1, wherein the functionalized PVEC cushion is configured as at least one layer in a mattress topper.

10. The functionalized PVEC cushion with integrated PVEC coupling according to claim 1, wherein the functionalized PVEC cushion is configured as at least one layer in a mattress.

11. The functionalized PVEC cushion with integrated PVEC coupling according to claim 1, wherein the functionalized PVEC cushion is configured as at least one layer in a seat.

12. The functionalized PVEC cushion with integrated PVEC coupling according to claim 1, wherein the functionalized PVEC cushion is configured as at least one layer in a seat cushion.

13. A method for functionalizing a compressible nonwoven material (CNM) cushion, into a functionalized pressure-varying electrical conductance (PVEC) CNM cushion with a conductive ink printed-on-thermoplastic film (CPT), multi-area PVEC conductance measurement coupling, comprising steps of:

functionalizing the CNM cushion into a PVEC CNM cushion, including a forming within the CNM cushion of a three-dimensional (3D) CNM PVEC region, having a PVEC surface area on a surface of the CNM cushion, the 3D CNM PVEC region having a structure comprising conductive polymer carrying CNM fibers, at least partially covered with a thin film of solidified conductive polymer, and elastically separated by a pressure dependent distribution of empty spaces; and forming the CPT multi-area PVEC conductance measurement coupling by steps comprising conductive ink printing a configuration of conductive elements on disposition surfaces of a surface of a thermoplastic film, the configuration of conductive elements including a first conductive contact pad and a second contact pad mutually spaced by a pad spacing, and including a first pad connection trace that extends from a first pad connection trace terminal end to the first contact pad, and a second pad connection trace that extends from a second pad connection trace terminal end to the second conductive contact pad, adhering, in an alignment, the CPT multi-area PVEC conductance measurement coupling to a surface of the PVEC CNM cushion, including the PVEC surface area, wherein the adhering comprises heat and pressure urging of portions of the surface of the thermoplastic film to extend over upper surfaces of the conductive elements and onto adjacent areas of the surface of the functionalized CNM PVEC cushion, the alignment includes the first conductive contact pad and the second conductive contact pad each being in direct electrical contact with the PVEC surface area, and the insulation is configured to electrically insulate the first pad connection trace at least from the PVEC surface area, and to electrically insulate the second pad connection trace at least from the PVEEC surface area.

14. The method of claim 13, wherein the surface of the thermoplastic film is a first surface and provisioning the functionalized CNM PVEC cushion with the insulation and with the CPT multi-area PVEC conductance measurement coupling further comprises:

positioning the CPT multi-area PVEC conductance measurement coupling into a spatial orientation and alignment, the spatial orientation including the surface of the thermoplastic film facing the surface of the functionalized CNM PVEC cushion, and the alignment including the conductive contact pad pair being aligned within the PVEC surface area, positioning, in accordance with the alignment, the CPT multi-area PVEC conductance measurement coupling against the surface of the functionalized CNM PVEC cushion, to a contact position in which the conductive contact pad pair is in a direct electrical contact with the PVEC surface area, and applying pressure on the CPT multi-area PVEC conductance measurement coupling urging the surface of the thermoplastic film and the conductive elements against the surface of the functionalized CNM PVEC cushion, or applying a heating to the CPT multi-area PVEC conductance measurement coupling, or both, until the respective portions of the thermoplastic film extend over the upper surfaces of the conductive elements and onto and adhere to the adjacent areas of the surface of the functionalized CNM PVEC cushion.

15. The method of claim 13, wherein the 3D PVEC region is a first 3D PVEC region, the PVEC surface area is a first PVEC surface area, the pair of contact pads is a first pair of contact pads, and the pair of pad connection traces is a first pair of pad connection traces, and the steps of functionalizing the CNM cushion into the PVEC CNM cushion further comprise establishing within the CNM cushion a second 3D PVEC region, having a second PVEC surface area on the surface of the CNM cushion, and having the PVEC structure, the step of conductive ink printing, on disposition areas on the surface of the thermoplastic film, further include in the configuration of conductive elements, a second pair of contact pads, mutually spaced by a second pad spacing, and a second pair of pad connection traces extending, separately, from the second pair of contact pads to a second pair of pad connection trace terminals; and the positioning further includes the second pair of conductive contact pads being aligned with and having direct electrical contact with the second PVEC surface area, the insulation is further configured to insulate the second pair of pad connection traces from the second PVEC surface area.

16. The method of claim 14, wherein the pair of conductive contact pads is a first pair of conductive contact pads, the pair of pad connection traces is a first pair of pad connection traces, and the pad spacing is a first pad spacing, the step of conductive ink printing, on disposition areas on the surface of the thermoplastic film, further includes, in the configuration of conductive elements, a second pair of conductive contact pads and a second pair of pad connection traces, the second pair of conductive contact pads mutually spaced by a second pad spacing, the step of conductive ink printing is further configured to include, in the configuration of conductive elements form a pad connection trace of the second pair of pad connection traces in a configuration extending from a contact pad of the second pair of contact pads to a trace terminal of a second pair of trace terminals, and the other of the pad connection traces of the second pair of pad connection traces in a configuration extending from the other contact pad of the second pair of contact pads to the other trace terminal of the second pair of trace terminals, the first pair of contact pads directly contacts the PVEC surface area at a respective first pair of contact locations, mutually spaced by the first pad spacing, the positioning further includes the second pair of contact pads directly contacting the PVEC surface area at a respective second pair of contact locations, mutually spaced by the second pad spacing, wherein a reference centroid of the first pair of contact locations is a first reference centroid, and a reference centroid of the second pair of contact locations is a second reference centroid, and the step of conductive ink printing is further configured to such that a distance from the first reference centroid to the second reference centroid is substantially greater than a largest among the first pad spacing and second pad spacing.

17. A method of provisioning a functionalized compressed nonwoven material (CNM) cushion having integer N three-dimensional (3D) functionalized pressure-varying electrical conductance (PVEC) regions, with a conductive ink printed-on-thermoplastic film (CPT), multi-area PVEC measurement coupling, comprising steps of:

forming the CPT multi-area PVEC conductance measurement coupling, comprising conductive ink printing a configuration of conductive elements on disposition surfaces of a surface of a thermoplastic film, the configuration of conductive elements including integer N conductive contact pad pairs, each nth contact pad pair including a first conductive contact pad and a second contact pad mutually spaced by a pad spacing, and including integer N pad connection trace pairs, each nth pad connection trace corresponding to an nth conductive pair and pair including a first pad connection trace that extends from a first pad connection trace terminal end to the first contact pad of the nth conductive contact pad pair, and a second pad connection trace that extends from a second pad connection trace terminal end to the second conductive contact pad of the nth conductive contact pad pair, adhering, in an alignment, the CPT multi-area PVEC conductance measurement coupling to a surface of the PVEC CNM cushion, including the PVEC surface area, wherein the adhering comprises heat and pressure urging of portions of the surface of the thermoplastic film to extend over upper surfaces of the conductive elements and onto adjacent areas of the surface of the functionalized CNM PVEC cushion, the alignment includes the first conductive contact pad and the second conductive contact pad of each nth conductive contact pad pair each being in direct electrical contact with the associated nth PVEC surface area, and the insulation is configured to electrically insulate the first pad connection trace and the second pad connection trace of each nth pad connection trace pair from at least from the nth PVEC surface area.

18. A method of provisioning a functionalized nonwoven material (NWM) cushion having a three-dimensional (3D) functionalized pressure-varying electrical conductance (PVEC) region forming a PVEC surface contact and measuring coupler, by steps with a PVEC surface area on an external surface of the functionalized NWM cushion, with a secured, flexible configuration of conductive contact pads and pad connection traces, comprising:

positioning, in an alignment on an outer surface of the functionalized NWM cushion, an arrangement of contact pads and pad connection traces disposed on an underside of an overlaying thermoplastic film, the arrangement and alignment including a first contact pad and a second conductive pad, spaced apart and in respective direct electrical contact with the PVEC surface area, a first pad connection trace extending from the first contact pad to a first trace terminal, in insulated contact with the PVEC surface area via a first insulation coating, and a second pad connection trace extending from the second contact pad to a second trace terminal, in insulated contact with the PVEC surface area via a second insulation coating; and securing, in the alignment, the arrangement of contact pads and pad connection traces to an outer surface of the functionalized NWM, by operations comprising heat and pressure adhering portions of the thermoplastic film to the outer surface.

19. The method of claim 18, wherein, in the alignment, a first portion of the PVEC surface area, adjacent the first conductive contact pad, is a first adjacent surface area, a second portion of the PVEC surface area, adjacent the second conductive contact pad, is a second adjacent surface area, a third portion of the VEC surface area, alongside and adjacent the first pad connection trace, is a third adjacent surface area, and a fourth portion of the VEC surface area, alongside and adjacent the second pad connection trace, is a fourth adjacent surface area; and the heat and pressure adhering portions of the thermoplastic film to the outer surface includes heat and pressure adhering a first portion of the thermoplastic film to respective regions of the first adjacent surface area that are on opposite sides of the first contact pad, a second portion of the thermoplastic film to respective regions of the second adjacent surface area that are on opposite sides of the second contact pad, a third portion of the thermoplastic film to respective regions of the third adjacent surface area that are on opposite sides of the first pad connection trace, and a fourth portion of the thermoplastic film to respective regions of the fourth adjacent surface area that are on opposite sides of the second pad connection trace.

20. The method of claim 19, further comprising:

removing regions of the thermoplastic film that are outside the union of the first adjacent surface area, the second adjacent surface area, the third adjacent surface area, and the fourth adjacent surface area.

21. The method of claim 20, wherein the removing regions includes a laser cutting of at least portions of the regions of the thermoplastic film outside the union of the first adjacent surface area, the second adjacent surface area, the third adjacent surface area, and the fourth adjacent surface area.

22. The method of claim 18, wherein the thermoplastic film comprises a thermoplastic polyurethane.

23. The method of claim 18, wherein:

the first conductive contact pad, the second conductive contact pad, the first pad connection trace, and the second pad connection trace comprise dried conductive ink on the underside of the thermoplastic film, and the first insulation coating and the second insulation coating comprise an insulating polymer.

* * * * *